US008573232B2

(12) United States Patent
Glenn, Jr. et al.

(10) Patent No.: US 8,573,232 B2
(45) Date of Patent: Nov. 5, 2013

(54) HAIR TREATMENT APPLICATION SYSTEM COMPRISING AN ABSORBENT SUBSTRATE

(75) Inventors: Robert Wayne Glenn, Jr., Liberty Township, OH (US); Paul James Smith, Twickenham (GB)

(73) Assignee: The Procter & Gamble Company, Cincinnati, OH (US)

( * ) Notice: Subject to any disclaimer, the term of this patent is extended or adjusted under 35 U.S.C. 154(b) by 1128 days.

(21) Appl. No.: 11/973,584

(22) Filed: Oct. 9, 2007

(65) Prior Publication Data

US 2008/0083419 A1 Apr. 10, 2008

(30) Foreign Application Priority Data

| | | |
|---|---|---|
| Oct. 9, 2006 | (EP) | 06021164 |
| Oct. 12, 2006 | (EP) | 06122213 |
| Dec. 21, 2006 | (EP) | 06126910 |
| Aug. 30, 2007 | (EP) | 07115334 |
| Sep. 30, 2007 | (EP) | 07115337 |

(51) Int. Cl.

| | |
|---|---|
| ***A61Q 5/08*** | (2006.01) |
| ***A45D 19/18*** | (2006.01) |
| ***A45D 24/16*** | (2006.01) |

(52) U.S. Cl.
USPC ..... 132/270; 132/208; 132/108

(58) Field of Classification Search
USPC ..... 132/270, 202, 208, 320, 108; 206/581; 401/10
See application file for complete search history.

(56) References Cited

U.S. PATENT DOCUMENTS

| | | | | |
|---|---|---|---|---|
| 2,272,409 | A | 2/1942 | Johnson | |
| 2,310,295 | A | 2/1943 | Keele | |
| 2,705,499 | A * | 4/1955 | Breeze | 132/109 |
| 2,776,667 | A | 1/1957 | Fitzgerald | |
| 3,030,968 | A | 2/1960 | Oberstar | |
| 2,962,031 | A | 11/1960 | Bumgarner | |
| 3,662,767 | A | 5/1972 | Murtha | |
| 3,702,508 | A | 11/1972 | Netter | |
| 3,921,647 | A | 11/1975 | Fisher | |
| 4,020,854 | A | 5/1977 | Caruso | |
| 4,108,184 | A | 8/1978 | Morganroth | |
| 4,398,549 | A | 8/1983 | Thomas | |
| 4,503,870 | A | 3/1985 | Peterson | |

(Continued)

FOREIGN PATENT DOCUMENTS

| | | | |
|---|---|---|---|
| DE | 662702 | C1 | 7/1938 |
| DE | 197639177 | U1 | 4/1977 |

(Continued)

*Primary Examiner* — Rachel Steitz
(74) *Attorney, Agent, or Firm* — James T. Fondriest

(57) ABSTRACT

The present invention describes a hair treatment application system, comprising at least one or more hair treatment compositions (15) having a viscosity of from 3,000 cPs to 150,000 cPs and a hair treatment application device (1) comprising a first plate (10) and a second plate (20) positionable in a juxtaposed relationship when said hair treatment application device (1) is in a closed state. The hair treatment application device (1) is characterized by having a first zone comprising at least one absorbent substrate (40) on the internal surface (101) of said at least said first plates (10) and a second zone (50) on said internal surface (101) which is free of said absorbent substrate (40). Said at least one absorbent substrate (40) has a median pore radius of from 300 microns to 3,000 micron. The present invention describes also methods of treating the hair with said hair treatment application system (10) and kit comprising said hair treatment application system.

11 Claims, 2 Drawing Sheets

(56) References Cited

U.S. PATENT DOCUMENTS

| | | | | |
|---|---|---|---|---|
| 4,796,812 | A | 1/1989 | Grollier | |
| 4,942,893 | A | 7/1990 | Trottier | |
| 5,042,514 | A | 8/1991 | Bastien | |
| 5,060,679 | A | 10/1991 | Christopher | |
| 5,279,313 | A | 1/1994 | Clausen | |
| 5,535,764 | A | 7/1996 | Abramson | |
| 5,554,197 | A | 9/1996 | Assini | |
| 5,771,906 | A | 6/1998 | De Benedictis | |
| 5,823,204 | A | 10/1998 | Todd | |
| 5,848,730 | A | 12/1998 | Kawase | |
| 5,971,645 | A | 10/1999 | Fukushima | |
| 6,062,231 | A | 5/2000 | De Laforcade | |
| 6,148,829 | A | 11/2000 | De Benedictis | |
| 6,250,312 | B1 * | 6/2001 | Dasilva | 132/208 |
| 6,427,701 | B1 | 8/2002 | Roth | |
| 6,440,175 | B1 | 8/2002 | Stanley | |
| 6,626,599 | B2 * | 9/2003 | De Laforcade | 401/10 |
| 6,748,957 | B1 | 6/2004 | Giordano | |
| 6,968,849 | B2 * | 11/2005 | Vena et al. | 132/208 |
| 7,025,069 | B2 | 4/2006 | Thiebaut | |
| 7,175,021 | B2 * | 2/2007 | Colombo | 206/204 |
| 7,198,049 | B2 | 4/2007 | Elmer | |
| 7,357,137 | B2 | 4/2008 | Husband | |
| 7,425,220 | B2 | 9/2008 | Barrass | |
| 7,475,688 | B2 | 1/2009 | Colacioppo | |
| 7,543,591 | B1 | 6/2009 | Munsil | |
| 7,640,939 | B2 | 1/2010 | Ploix | |
| 2002/0114657 | A1 | 8/2002 | Gueret | |
| 2002/0142027 | A1 | 10/2002 | Gueret | |
| 2002/0197228 | A1 | 12/2002 | Lasala | |
| 2003/0007825 | A1 | 1/2003 | De Laforcade | |
| 2004/0016064 | A1 | 1/2004 | Vena | |
| 2004/0031502 | A1 | 2/2004 | Winckels | |
| 2004/0089316 | A1 | 5/2004 | Hamilton | |
| 2004/0182408 | A1 | 9/2004 | De LaForcade | |
| 2005/0079192 | A1 | 4/2005 | Simon | |
| 2005/0207153 | A1 | 9/2005 | Leleve | |
| 2005/0211599 | A1 | 9/2005 | De LaMettrie | |
| 2006/0042643 | A1 | 3/2006 | Delan | |
| 2006/0064824 | A1 | 3/2006 | Godfrey | |
| 2006/0090771 | A1 | 5/2006 | Ramet | |
| 2006/0144415 | A1 | 7/2006 | Magee | |
| 2006/0207036 | A1 | 9/2006 | Kennedy | |
| 2007/0144550 | A1 | 6/2007 | Roher | |
| 2007/0215170 | A1 | 9/2007 | Kennedy | |
| 2007/0227620 | A1 | 10/2007 | Kunii | |
| 2007/0251039 | A1 * | 11/2007 | Kobayashi et al. | 15/104.095 |
| 2008/0000492 | A1 | 1/2008 | Mills | |
| 2008/0083418 | A1 | 4/2008 | Glenn | |
| 2008/0083419 | A1 | 4/2008 | Glenn | |
| 2008/0083420 | A1 | 4/2008 | Glenn | |
| 2008/0087292 | A1 | 4/2008 | Abergel | |
| 2008/0087293 | A1 | 4/2008 | Glenn | |
| 2008/0087294 | A1 | 4/2008 | Glenn | |
| 2008/0110929 | A1 | 5/2008 | Stanley | |
| 2008/0156817 | A1 | 7/2008 | Roseblade | |
| 2008/0196734 | A1 | 8/2008 | Husband | |
| 2008/0223386 | A1 | 9/2008 | Albisetti | |
| 2008/0223391 | A1 | 9/2008 | Baker | |
| 2008/0223393 | A1 | 9/2008 | Boyle | |
| 2008/0257370 | A1 | 10/2008 | Perry | |
| 2008/0308119 | A1 | 12/2008 | Smith | |
| 2009/0050171 | A1 | 2/2009 | Barrass | |
| 2009/0071496 | A1 | 3/2009 | Glenn | |
| 2009/0084393 | A1 | 4/2009 | Baker | |
| 2009/0084394 | A1 | 4/2009 | Baker | |
| 2009/0084395 | A1 | 4/2009 | Glenn | |
| 2009/0095314 | A1 | 4/2009 | Lund | |
| 2009/0101159 | A1 | 4/2009 | Bonnafous | |
| 2009/0152281 | A1 | 6/2009 | Bowes | |
| 2009/0223531 | A1 | 9/2009 | Lund | |

FOREIGN PATENT DOCUMENTS

| | | | |
|---|---|---|---|
| DE | 198805283 | U1 | 7/1988 |
| DE | 3138389 | C2 | 7/1990 |
| DE | 4041742 | A1 | 6/1992 |
| DE | 29616331 | U1 | 12/1996 |
| DE | 29917054 | U1 | 8/2000 |
| DE | 10259016 | A1 | 6/2004 |
| DE | 202004017014 | U1 | 6/2005 |
| DE | 20221665 | U1 | 11/2006 |
| DE | 102005058188 | A1 | 6/2007 |
| DE | 202007016018 | U1 | 4/2008 |
| EP | 1138374 | A1 | 10/2001 |
| EP | 1566114 | A1 | 8/2005 |
| EP | 1264559 | B1 | 11/2005 |
| EP | 1897459 | A1 | 3/2008 |
| EP | 1915920 | A1 | 4/2008 |
| EP | 1481605 | B1 | 8/2009 |
| FR | 2444421 | A1 | 7/1980 |
| FR | 2495905 | A1 | 6/1982 |
| FR | 2854778 | A1 | 11/2004 |
| FR | 2905833 | A1 | 3/2008 |
| GB | 274875 | A | 10/1927 |
| GB | 2242357 | A | 10/1991 |
| GB | 2383944 | A | 7/2003 |
| GB | 2384425 | A | 7/2003 |
| JP | 4-41305 | | 4/1992 |
| JP | 10290712 | A | 11/1998 |
| JP | 11-178630 | | 7/1999 |
| JP | 11-178639 | A | 7/1999 |
| JP | 2001-211925 | A | 8/2001 |
| JP | 2001523500 | A | 11/2001 |
| JP | 2002-034636 | A | 2/2002 |
| JP | 2003-199623 | A | 7/2003 |
| JP | 2003-310337 | A | 11/2003 |
| JP | 2004338725 | A | 12/2004 |
| JP | 2006043434 | A | 2/2006 |
| JP | 2006082852 | A | 3/2006 |
| JP | 3129205 | U | 2/2007 |
| WO | WO 93/02589 | A1 | 2/1993 |
| WO | WO 93/10687 | A1 | 6/1993 |
| WO | WO 98/43511 | A1 | 10/1998 |
| WO | WO 02/074129 | A1 | 9/2002 |
| WO | WO 2006/010354 | A1 | 2/2006 |

* cited by examiner

HAIR TREATMENT APPLICATION SYSTEM COMPRISING AN ABSORBENT SUBSTRATE

CROSS REFERENCE TO RELATED APPLICATIONS

This application claims the benefit of U.S. application Ser. No. 11/634,648, filed on Dec. 6, 2006.

FIELD OF THE INVENTION

The present invention relates to a hair treatment application system which comprises a cosmetic composition and an application device which allows for easy, precise, gentle and non-messy targeted application of cosmetic compositions to various substrates, such as hair, skin and fingernails. The application device according to the invention is especially intended for hair treatment compositions.

BACKGROUND OF THE INVENTION

Applications of hair treatment compositions to distinct hair strands allow to achieve a different look than a full head application. Hair treatment compositions for providing such hair strand effects include highlighting compositions, dyeing compositions and styling compositions. Dyeing and styling compositions, in particular, are used to accommodate changes in fashion and style and to provide masking of the first grey hair.

Although under the term highlighting it is understood to be the selection of hair strands which are lightened at least one shade lighter than the rest of the hair, the results expected by consumers are quite variable, from subtle multi-tonal effects and natural colour variations to more bold and daring effects. To achieve a personal customization of the end-look, the consumer can choose to perform highlighting by employing home highlighting kits or may visit a professional stylist.

Professionals have a number of devices and techniques at their disposal which together with training and years of experience allow the variety of results expected by the consumers to be delivered. However, due to the accuracy and length of the process, the consumer is required to regularly spend a number of hours at the salon in order to complete the process. Because of the long time and effort employed by the professionals to achieve the expected end results, a high premium is also demanded by the professional stylists for their services.

The home highlighting product market is vast, financially accessible to consumers and offers various products to deliver practically any desired hair lift.

However, a number of drawbacks are associated with using home hair highlighting treatments without assistance of a professional and some attempts to address these problems are known in the art.

Application articles composed of multiple layers of different materials as well as sponges able to deliver cosmetic compositions are generally known. The combination of such application articles with devices or tools is also known. One example is an applicator comprising a cylinder-shaped reservoir for containing a hair treatment composition, wherein said reservoir has a lateral opening where an elastic deformable material is lodged. Through that opening the hair strand is set into communication with the composition contained in the reservoir. Another example is an applicator comprising an applicator portion and a fastening means. The applicator portion comprises an elastically compressible container where the hair treatment composition is lodged. The user positions a hair strand between one finger and the container. Upon application of pressure on the compressible container, the composition contained therein is released onto the hair strand. Other examples include hair cosmetic applicators which have two hinged plates, each carrying either bags comprising hair treatment compositions or sheet brush covered by non-woven fabric impregnated with hair treatment compositions. Applicators comprising two interlocking hinged plates covered with an absorbent material are also known and work as a replacement for foils used by stylists in professional salons.

It is generally recognized that self-application of highlighting compositions are difficult per se and they may not become easier if carried out with an inappropriate application device. An applicator device capable of facilitating self-application of hair treatment compositions needs to consider and address several technical challenges to achieve the expected end results in a clean and tidy fashion/manner.

First of all, the application of hair treatment compositions at the back of the head is complicated as it requires the user to select hair strands by judging on a mirror image. The more complicated the strand selection and application are, the longer the users are obliged to maintain their arms over their head, creating discomfort and affecting the overall results. Furthermore, the user naturally rotates the device by 180° to achieve highlights at the back of the head. Thus, even applicators which successfully contain the hair treatment composition for applications on the front or side of the head, may not perform efficiently and may cause impairment of the self-application at the back of the head.

The technical challenge to prevent leaking and oozing out of the compositions from the applicator should not be considered only in view of the orientation of the applicator during application. Applicators for self-application of hair treatment compositions should be designed to prevent leaking and oozing of the hair treatment composition from the applicator during the whole application experience as the unpleasant nature of some compositions, such as highlighting compositions may cause bleaching if dripped onto the consumer's home surfaces, skin and clothes.

Leaking and oozing are unwanted not only for cleanness purposes. To achieve the expected end result it is necessary for the highlighting composition to be precisely applied where desired. Even a little amount of hair highlighting composition at the edge of the applicator may still provide unexpected results as it could easily be transferred from the selected hair strand to unselected ones, especially at the root-line. As a result, an unanticipated and undesired overall final appearance may occur.

It should also be considered for toxicological and safety reasons that if unexpectedly the hair highlighting composition is delivered at the root-line, it may be also transfer to the scalp causing unnecessary irritations.

Finally, hair treatment compositions such as hair highlighting compositions comprise components that need to generate active oxygen to bleach the melanin pigments. In view of their reactive chemical nature most applications of hair highlighting compositions exert a subtle and temporary impairment in hair health. Applicators, such the cap and hook, may stress the hair shaft and may even uproot the hair strand if improperly used. Thus, hair treatment applicators in general but in particular those designed to perform highlighting must not damage the hair and must be gentle to the hair while the user applies the hair treatment composition.

Thus, what still remains unsolved is the provision of a hair treatment applicator to satisfy the home highlighting consumers' needs in terms of avoiding the leaking of the highlight composition from the applicator and easiness to use with one hand, to pick up, grip, hold and lay back down. Moreover, the applicator should be easy to guide through the hair particularly at the root line and to perform several applications irrespective of the hair length. The applicator should provide flexibility for creating a high variety of highlights and new fashions, for shortening the time and costs and for simplifying the highlight performances. The applicator should also not damage the hair while the hair treatment composition is applied. Finally, the applicator should be doubtless light, cheap, disposable or recyclable and easy to produce.

It has now been found that a hair treatment application system (as defined herein after) can significantly improve the highlighting results at home as well as at professional salons.

SUMMARY OF THE INVENTION

According to the invention, a hair treatment application system is provided, comprising at least one or more hair treatment compositions (15) having a viscosity of from 3,000 cPs to 150,000 cPs and a hair treatment application device (1) comprising a first plate (10) and a second plate (20) positionable in a juxtaposed relationship when said hair treatment application device (1) is in a closed state, wherein said first (10) and second plates (20) are coupled together via a connection (30), wherein said first (10) and second plates (20) each has an internal (101; 201) and external (102; 202) surface and said first (10) and second plates (20) each has a perimeter edge (103; 203), characterized in that, at least said first plate (10) has on the internal surface (101) a first zone and a second zone (50), wherein said first zone comprises at least one absorbent substrate (40), wherein said at least one absorbent substrate (40) has a median pore radius of from about 300 microns to about 3,000 microns and wherein said second zone (50) is free of said absorbent substrate (40).

The present invention further relates to methods of treating the hair with said hair treatment application system and kit comprising said hair treatment application system.

DETAILED DESCRIPTION OF THE INVENTION

Figure 1:
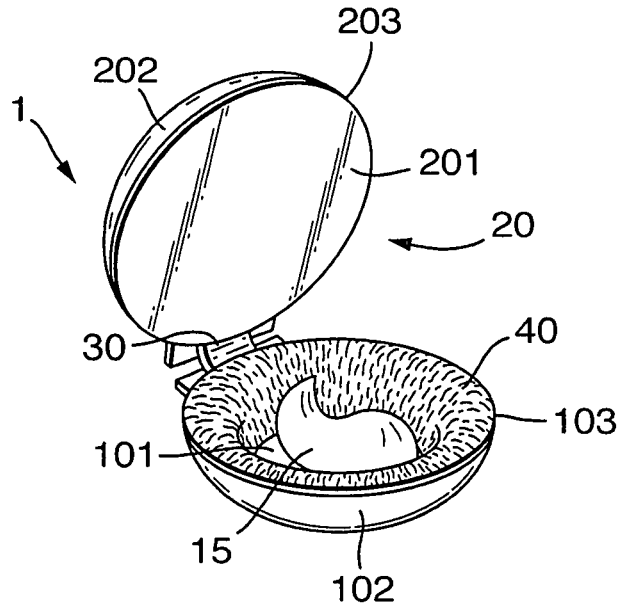
FIG. 1 is the perspective view of one embodiment of the hair treatment application device (1) according to the invention. The hair treatment application device (1) comprises a first (10) and second (20) plate coupled together via a connection (30). Each plate (10; 20) comprises an internal (101; 201) and external (102; 202) surface and a perimeter edge (103; 203). An absorbent substrate (40) is attached to the first zone of the internal surface (101) of the first plate (10). The second zone, free of absorbent substrate, is occupied by a hair treatment composition (15). In this embodiment, the first plate (10) comprises a concave depression on said first plate (10). The second zone is not visible.

The present invention is characterized by the synergistic effect that the features described herein have when combined all together. Herein after it will become apparent how each of the features are interrelated one to another and how they jointly contribute to the solution of the above described technical problem.

The specific selection of the viscosity of the hair treatment compositions from about 3,000 cPs to about 150,000 cPs; the specific absorbent substrate having median pore radius of from about 300 microns to about 3,000 microns; and the elements of the application device are all critical in order to deliver the desired technical effect.

The hair treatment application device (1) comprises a first (10) and a second (20) plates coupled together via a connection (30) to allow the user to guide the hair treatment application device (1), with the use of either hand, precisely and easily, including hard to access sectors such as at the back of the head or at the root of the hair close to the scalp. The absorbent substrate (40) provides the application device (1) with an excellent means to prevent bleeding of the hair treatment composition from the application device (1) and helps to reduce excessive deposition of hair treatment composition during application onto the hair. The porous nature of the absorbent substrate (40) is specifically selected to achieve a gentle and smooth application of the hair treatment composition (15). The presence of an area free of absorbent substrate (40) allows for better management of the hair treatment composition (15) once it is displaced from the absorbent substrate (40) when the first and second plates (10; 20) are brought into juxtaposed relationship to apply the hair treatment composition (15) to the hair.

The combination of all these features allows the delivery of a hair treatment composition (15) to the selected hair strands in a homogeneous, gentle, non-messy and clean fashion.

The viscosity of the hair treatment composition is also of high importance. If it is too high, it is not easily absorbed into the absorbent substrate and it is most likely to adhere within the zone free of absorbent substrate. Moreover inter-mixing of two or more differing hair treatment compositions, which is desirable for reactive hair treatment applications such as oxidative dyeing and bleaching including highlighting, if required, can be prohibited.

On the other hand, if the viscosity of the hair treatment composition is too low the highlighting experience may become messy as the hair treatment composition is not sufficiently retained within the absorbent substrate and the zone free thereof, causing undesirable dripping and messiness.

As demonstrated hereinafter by the technical experimental data, the minimum viscosity of the hair treatment compositions, measured according to the test method described hereafter, is of at least about 3,000 cPs. Solutions of Carbopol® 956 (available form Noveon) prepared at various concentrations to afford a comprehensive range of viscosities were tested with diverse types of absorbent substrates having a wide range of median pore radii. The Carbopol® 956 solutions were prepared by adding Carbopol® 956 to deionized water while mixing the solution using an over-head stirrer until all the Carbopol® 956 dissolved. Additional Carbopol® 956 was added in the solution until the required viscosity was achieved. Each of the Carbopol® 956 solutions was loaded into the chosen absorbent substrates. The absorbent substrates were then compressed as described in the test method herein after. Each experiment was repeated three times and the results were evaluated using the Student t-test ($\propto$=0.05) and statistically different averages are denoted by different letters in square brackets for each absorbent substrate. The average percentage of the loaded solution that dripped out from the absorbent substrate under compression and the corresponding viscosities are shown in Table 1.

TABLE 1

Effect of viscosity changes versus median pore radius of the absorbent substrate.

| | Absorbent substrates | | | | | |
|---|---|---|---|---|---|---|
| | BBA Fiberweb Tenotex P101 | | Libeltex 01-766 DI-8 | | Recticel Bulpren S28280 | |
| | Median Pore Radii | | | | | |
| | 75 microns | | 550 microns | | 1,400 microns | |
| Viscosity [cPs] | Average | Std Dev. | Average | Std Dev. | Average | Std Dev. |
| 1000 | 29.93 [A] | 1.16 | 32.95 [A] | 1.50 | 10.08 [A] | 1.48 |
| 1500 | 26.26 [B] | 3.60 | 30.29 [B] | 1.24 | 7.93 [B] | 1.88 |
| 2000 | 12.96 [C] | 2.42 | 17.66 [C] | 0.92 | 3.59 [C] | 1.60 |
| 3000 | 0 [D] | 0 | 8.92 [D] | 0.74 | 0 [D] | 0 |
| 3500 | 0 [D] | 0 | 0 [E] | 0 | 0 [D] | 0 |
| 5000 | 0 [D] | 0 | 0 [E] | 0 | 0 [D] | 0 |
| 7500 | 0 [D] | 0 | 0 [E] | 0 | 0 [D] | 0 |
| 10000 | 0 [D] | 0 | 0 [E] | 0 | 0 [D] | 0 |

These results clearly illustrate that as the viscosity increases the percentage of Carbopol® 956 solution that drips out from the absorbent substrate significantly decreases. Surprisingly, it has been found that, independently from the absorbent substrate chosen, dripping was substantially absent when the absorbent substrates were loaded with a Carbopol® 956 solution having viscosity of at least about 3,000 cPs.

To further support the above discussed experimental data on the hair treatment composition according to the invention, a consumer test with 12 panellists was also undertaken. Each panellist was given an absorbent substrate (Libeltex 01-766 DI-8, median pore radius 550 microns) to test and to evaluate its messiness and dripping. The absorbent substrate was mounted on one side of a plate as described herein after in the test methods section. Two such prepared plates were hinged together so as to form a clip with the absorbent substrates facing one another. One absorbent substrate per clip was loaded with solutions of Carbopol® 956 having a viscosity of 1,000 cPs. Other clips were prepared with Carbopol® 956 solutions having viscosities of 2,500 cPs and 5,000 cPs.

The results were evaluated with the Fisher's LSD statistical test ($\propto$=0.05), revealing the average grade for both the Carbopol® 956 solutions at viscosity of 1,000 and 2,500 cPs viscosity fluids are statistical identical for the asked question and that the one at 5,000 cPs is significantly different and rated as being less messy. These results, shown in table 2, support the technical experimental data that the viscosity required to avoid messiness is in the range between 2,500 cPs to 5,000 cPs. Statistically different averages are denoted by different letters in square brackets.

TABLE 2

Consumer testing for messiness.

| Question | Considering the sample you have just used, how would you rate its mess? |
|---|---|
| Grade | Scale: 0-8<br>0 = Not Messy at All<br>4 = Somewhat Messy<br>8 = Extremely Messy |
| Viscosity [cPs] | Average of All Grades |
| 1000 | 3.83 [B] |
| 2500 | 3.92 [B] |
| 5000 | 2.00 [A] |

The present inventors have also surprisingly found that a very specific type of absorbent substrate is required. Specifically, the absorbent substrates of the present invention are selected such that they posses a median pore radii that can accommodate one or more hair treatment compositions having a minimum viscosity of at least about 3,000 cPs. The porous nature of absorbent substrates is accurately described by the median pore radius. This is conventionally established via the TRI Autoporosimeter® methodology for samples with median pore radii less than or equal to 1000 microns and by optical imaging for samples with radii greater than 1000 microns as defined herein after. The effect of median pore radius of absorbent substrates useful within the scope of the present invention was determined using a gravimetric fluid loading as described herein after in the test method section. This method represents best how a consumer may load absorbent substrates with hair treatment compositions. The absorbent substrates chosen were BBA Fiberweb Tenotex P101 (median pore radius of 75 microns); Freudenberg AL 1060 (300 microns); Libeltex 01-766 DI-8 (550 microns); PGI FB-215 (700 microns) and Recticel Bulpren S28280 (1,400 microns). Each absorbent substrate was loaded with Carbopol® 956 solutions having a viscosity of about 3,000 cPs, about 5,000 cPs and about 10,000 cPs, respectively. Each experiment was repeated three times and results were evaluated using the Student t-test ($\propto$=0.05) and statistically different averages are denoted by different letters in square brackets for each Carbopol® 956 solution. The average amount (in grams) of Carbopol® 956 solution loaded into each gram of absorbent substrate at the corresponding viscosity is shown in Table 3.

TABLE 3

Effect of the minimum median pore radius of the absorbent substrate on loading.

| | Absorbent substrate | | | | | |
|---|---|---|---|---|---|---|
| | BBA Fiberweb Tenotex P101 | | Freudenberg AL 1060 | | Libeltex 01-766 DI-8 | |
| | Median Pore Radii | | | | | |
| | 75 microns | | 300 microns | | 550 microns | |
| Viscosity [cPs] | Average | Std Dev. | Average | Std Dev. | Average | Std Dev. |
| 3000 | 1.25 [E] | 0.08 | 6.15 [D] | 0.92 | 30.24 [B] | 2.62 |
| 5000 | 0.70 [E] | 0.03 | 5.41 [D] | 0.53 | 24.86 [C] | 0.56 |
| 10000 | 0.40 [E] | 0.04 | 2.82 [D] | 0.30 | 17.50 [C] | 0.61 |

| | Absorbent substrate | | | |
|---|---|---|---|---|
| | PGI FB-215 | | Recticel Bulpren S28280 | |
| | Pore Radii | | | |
| | 700 microns | | 1,400 microns | |
| Viscosity [cPs] | Average | Std Dev. | Average | Std Dev. |
| 3000 | 37.54 [A] | 0.85 | 24.33 [C] | 0.48 |
| 5000 | 33.61 [A] | 1.68 | 27.38 [B] | 2.41 |
| 10000 | 22.38 [A] | 0.98 | 21.24 [B] | 0.28 |

The results illustrate that by increasing the median pore radius of the absorbent substrate, the amount of Carbopol® 956 solution which can be loaded into each absorbent substrate also increases. Furthermore, the results indicates that Carbopol® 956 solutions having minimum viscosity of 3,000 cPs could not significantly be loaded when the absorbent substrate has a median pore radius of less that 300 microns, such in the case of BBA Fiberweb Tenotex P101 which has a median pore radius of 75 microns.

Thus, for the purpose of the present invention, the median pore radius of the absorbent substrate is of at least about 300 microns. Below this minimum median pore radius, hair treatment compositions of viscosity of at least about 3,000 cPs cannot be accommodated for uses in the intended consumer applications of the present invention.

The maximum median pore radius of the absorbent substrates selected herein was determined to be the maximum radius of an open cell foam that is feasible to manufacture, that is commercially available and that is still capable of holding a shape while it is used for the intended consumer applications of the present invention. The maximum median pore radius open cell foam is provided by Recticel and has a median pore radius of 3,000 microns. Absorbent substrates having median pore radii higher than 3,000 microns have a tendency to lose their mechanical strength and thus are not employed within the scope of the present invention. Thus, the absorbent substrates according to the present invention have a median pore radius of from about 300 microns to about 3,000 microns, preferably from about 400 microns to about 2,500 microns, more preferably from about 450 microns to about 2,000 microns, even more preferably from about 500 microns to about 1,800 microns.

Hair treatment compositions have very diverse viscosities and presently commercially available products have viscosities up to 600,000 cPs. Within the scope of the present invention, the maximum viscosity of a hair treatment composition that can still be loaded on the absorbent substrates as selected above and delivered to the hair is 150,000 cPs. Two absorbent substrates representative of the above determined median pore radius range, Recticel Pottscorer 410 (2,200 microns) and Recticel Bulpren S28280 (1,400 microns), were chosen. These two absorbent substrates were then loaded with a hair treatment composition having viscosity of 100,000 cPs and three hair bundles were subsequently contacted with the absorbent substrates to coat the hair treatment composition on the hair. In both cases the absorbent substrates were able to provide the hair with enough hair treatment composition to achieve highlights. These results are shown in table 4 below.

TABLE 4

Effect of the viscosity on average dosage

| | Absorbent substrate | | | |
|---|---|---|---|---|
| | Recticel Bulpren S28280 | | Recticel Pottscorer 410 | |
| | Median Pore Radii | | | |
| | 1,400 microns | | 2,200 microns | |
| Mileage | Average | Std Dev. | Average | Std Dev. |
| Highlight 1st | 1.73 | 0.19 | 1.42 | 0.32 |
| Highlight 2nd | 1.50 | 0.30 | 0.68 | 0.30 |
| Highlight 3rd | 1.46 | 0.22 | 0.43 | 0.29 |

Although these results refer to a viscosity value of 100,000 cPs, the one skilled in the art of hair treatment compositions would find it easy to understand that hair treatment application compositions having viscosity up to about 150,000 cPs could still be loaded on the absorbent substrates according to the invention and applied to the hair. Thus, the hair treatment compositions according to the present invention are defined to have a viscosity of from about 3,000 cPs to about 150,000 cPs, more preferably from about 5,000 cPs to about 125,000 cPs, more preferably from about 7,000 cPs to about 100,000 cPs, even more preferably from about 9,000 cPs to about 85,000 cPs, wherein said viscosity is measured before application into the application device according to the test method described hereinafter.

In addition to the median pore radius, it has also been determined that selecting a defined absorbent capacity may also improve the application of the hair treatment composition onto the hair. The absorbent capacities of the absorbent substrates of the present invention can be described by the theoretical maximum uptake of water in grams per gram of substrate (grams per gram). The absorbent capacities of the absorbent substrates of the present invention are preferably in the range of from about 10 to about 80 grams of hair treatment composition per gram of absorbent substrate, preferably from about 15 to about 75 grams per gram, more preferably from about 20 to about 70 grams per gram, and even more preferably from about 25 to about 65 grams per gram of absorbent substrate as determined according to the calculation described herein after in the test method section.

The inventors have also determined that a selected calliper range of the absorbent substrate may also assist in delivering the required amount of hair treatment composition to the hair. The calliper is measured at the highest point on the absorbent substrate's surface conventionally via a micrometer according to the test method described herein after. The callipers of the absorbent substrates of the present invention are preferably in the range of from about 2 to about 20 mm, preferably from about 3 to about 17 mm, more preferably from about 4 to about 12 mm, and even more preferably from about 5 to about 10 mm.

Similarly, the selection of absorbent substrate materials which have a specific basis weight may also enhance the absorbent capacity. Preferably the absorbent substrates of the present invention also have a basis weight of from about 20 to about 300 g/m$^2$, preferably from about 60 to about 250 g/m$^2$, more preferably from about 100 to about 200 g/m$^2$, according to the test method described herein after.

Without wishing to be bound by theory, the present inventors believe that the combination of the selected median pore radius and calliper influence the liquid permeability of the absorbent substrate. The liquid permeability is a measure of the ability of a material to convey fluids.

For the purpose of this invention, the term hair refers to both living hair i.e. on a living body and to non-living hair i.e. in a wig, hairpiece or other aggregation of non-living keratinous fibre. Mammalian, preferably human hair is intended. However, wool, fur and other keratinous fibre may be suitable to be used with the hair treatment application system (10) according to the invention.

The term hair strand, for the purpose of this invention, refers to at least two keratinous fibres, especially hair, in particular human hair and it should be construed as hair bundle.

As used herein, the term "applied" when referring to a hair treatment composition is to encompass coated, loaded, absorbed, adsorbed and adhered.

While the specification concludes with claims, which particularly point out and distinctly claim the invention, it is believed the present invention will be better understood from the following description.

1. Plates

The hair treatment application device (1) of the present invention comprises a first (10) and a second (20) plate; both plates (10; 20) are of ergonomic size and can thus fit easily on either hand. The shape of the plates may vary. Rectangular, square, circular, elliptical or oblong shapes may be useful as they are easy to manufacture but other shapes, particularly those that are easily recognised by the consumers may be used. As shown in FIG. 1, each plate (10; 20) comprises an internal (101; 201) and external surface (102; 202). The internal surface (101; 201) of at least one of said plate (10; 20) has a first zone comprising an absorbent substrate (40) and a second zone free of said absorbent substrate (40) as described hereinafter.

The internal (101; 201) and/or external (102; 202) surfaces of each plate (10; 20) may be independently flat or curved, preferably the external surfaces (102; 202) are curved. Each plate or at least a portion thereof may comprise or one or more V-shaped grooves, one or more U-shaped grooves or combination thereof. Said grooves may be independently located on either or both the internal and external surfaces (101; 201; 102; 202) of either or both plates (10; 20).

Each plate may be of the same or different size and shape. Preferably, the shape of the first plate is the mirror image of the shape of the second plate (10; 20) for easy manufacture.

Each internal surface (101; 201) of said plates (10; 20) may have an area of from about 2 cm$^2$ to about 70 cm$^2$, preferably from about 3 cm$^2$ to about 50 cm$^2$, more preferably from about 4 cm$^2$ to about 30 cm$^2$.

In certain embodiments, at least a portion of said first plate (10) and/or second plate (20) may comprise a depression formed in said first plate (10), preferably a concave depression. In certain other embodiments, at least a portion of said first (10) and/or second plate (20) may form a cavity, preferably a concave cavity. Combination of cavities, grooves and depression may also be present within the same hair treatment application device (1).

The internal surface (101) of said first and/or second plate (10; 20) may further comprise one or more areas, which have visible or tactile differences from said internal surfaces (101; 201). Said one or more areas do not necessarily correspond to either zones and are in direct contact to said internal surfaces (101; 201). Said visible or tactile differences comprise differences in colour or shade, differences in patterns, markings or embossments.

Each plate (10; 20) may be independently manufactured from any known material or combination of materials capable of supporting a hair treatment composition. Suitable materials are polymer resins such as a polyolefin e.g. polypropylene, polyethylene or polyethylene teraphthalate. Other materials which could be used include polyvinylchloride, polyamide, acetyl, acrylonitrile butadiene styrene, acrylic, acrylonitrile styrene acrylate, ethylene vinyl alcohol, polycarbonate, polystyrene, silicone or thermo plastic elastomer, thermo plastic vulcanate or copolymers where appropriate; flexible pliable substrates such as paper boards, metal based substrates and aluminium foils, filmic substrates or multiple laminations or combinations of multiple layers of said materials.

The method of manufacture of the plates (10; 20) may include, but is not limited to, injection moulding, co-injection moulding, over moulding, in-mold assembly, compression moulding, blow moulding, thermo or vacuum forming of a blister type shell and lamination onto a carrier plastic or board material in the horizontal or vertical plane.

2. Connection

The selection of a connection (30) to couple together said first (10) and second (20) plates improves the user's perception of control over the hair treatment application device (1) and allows the user to guide the hair treatment application device (1), with the use of either hand, precisely and easily and also allows access to troublesome sections such as the back of the head or the root of the hair close to the scalp. In addition, the connection (30) allows the user to move the hair treatment application device (1) from one hair strand to another without having to adjust the position of the first (10) plate onto the second (20) plate after each application.

The connection (30) between the plates (10; 20) according to the present invention allows the hair treatment application device (1) to be in a closed state or in an open state. When the hair treatment application device (1) is in a closed state, said first plate (10) is in juxtaposed relationship to said second plate (20), whereas when the hair treatment application device (1) is in an open state said first plate (10) is distant from said second plate (20). When the hair treatment application device (1) is in an open state, the angle between said internal surfaces (101; 201) of said first and second plates (10; 20) may range between 5° and 360°, preferably between 30° and 185°, more preferably at least 50°. The connection (30) between said first (10) and second (20) plates is preferably of resilient nature. In certain embodiments the hair treatment application device (1) may be in an open state and said first (10) and second plates (20) may be brought together into a juxtaposed relationship by applying pressure on their external surfaces (102; 202). In certain embodiments the application device (1) may be in a closed state and pressure has to be applied on to the connection (30) to distance the internal surfaces (101; 201) of the first (10) and the second plate (20). In certain other embodiments, the application device (1) is in a closed state and each plate is provided with fastening means where the thumb and index finger may be positioned to assist the separation of the first and second plates (10, 20). Independently from their initial orientation, both the first (10) and the second (20) plates, by pivoting about the connection (30), may re-establish their initial orientation by springing back. The characteristics of the connection (30) may be an intrinsic property of the material used to manufacture the connection or may be provided by the design of the connection itself. The connection (30) should not break or get damaged so as to affect utility within a few applications. The connection (30) should not be too resistant to the applied pressure by the user, otherwise the user's hand and fingers may ache during repetitive use. On the other end, the connection (30) should not be too loose or else there is no perception of guidance over the application device (1). The spring back property should be effective otherwise said first and second plates (10; 20) may remain always either in a juxtaposed relationship or distant. However, the spring back should not occur uncontrollably and unexpectedly as it may otherwise cause tearing of the absorbent substrate (40) material comprised in said first zone or any other material comprised in any further additional zone (50). Uncontrolled spring back may also injure the user's hand and fingers and may displace inadvertently the hair treatment composition (15) from the hair treatment application device (1) causing messiness. The present inventors have surprisingly found that the connection (30) should work with applicable pressures ranging from 0.01 N/cm$^2$ to 30.0 N/cm$^2$, more preferably from 0.01 N/cm$^2$ to 15.0 N/cm$^2$, even more preferably from 0.01 N/cm$^2$ to 10.0 N/cm$^2$ and that the connection should have a spring back pressure to open ranging from 0.01 N/cm$^2$ to 30.0 N/cm$^2$, more preferably from 0.01 N/cm$^2$ to 15.0 N/cm$^2$ and even more preferably from 0.01 N/cm$^2$ to 10.0 N/cm$^2$.

The first (10) and the second (20) plates are coupled together via any suitable means that fulfils the above described requirements for the connection (30). In one embodiment, each plate (10; 20) comprises on the external surface (102; 202) a fitting means to accommodate the user's fingers, being the hand of the user the connection.

In a preferred embodiment, said connection (30) is a hinge. The hinge can be formed in a number of ways including: a "live" injection moulded hinge, a co-injected hinge, an over moulded hinge, in-mold assembly, a leaf spring or any other appropriate spring assembly, a strap hinge, a fold formed by a kiss-cut, score or crease.

In certain embodiments both the first (10) and the second (20) plates have a female part of the hinge incorporated in their design. The female part of the hinge is created during the manufacture process for the first and second plate (10; 20), for example during the injection moulding process. A pin is designed to fit both female parts of the hinge created on the first (10) and second plates (20). The pin, preferably of rectangular shape is manufactured from a polymer resin such as polyolefin, preferably polypropylene. The pin is assembled into the female parts of the plates (10; 20) to create the hinge.

In certain embodiments, both the first (10) and second (20) plates may be manufactured within the same injection mould for example from polypropylene. A living hinge also made from polypropylene may be created between the first (10) and the second (20) plate. Polypropylene may be used to provide a living hinge that can be flexed multiple times without breakage. The living hinge is typically closed during the de-moulding process.

In certain embodiments, both the first (10) and second (20) plates may be manufactured within the same injection mould for example from polypropylene and a hinge can be created by co-injection, in-mold assembly or over-moulding of a thermo plastic elastomer or a thermo plastic vulcanate or any other material that can be used to provide a hinge with the properties listed above.

3. Zones

The first zone is an area of said internal surface (101) of said at least first plate (10) characterized by the presence of at least one absorbent substrate (40). Said at least one absorbent substrate (40) comprises an inner surface, which is in direct contact with said internal surface (101) of said first plate (10), an outer surface and a lateral side. The absorbent substrate (40) provides the hair treatment application device (1) with an excellent measure to avoid messiness during the application of a hair treatment composition (15), preventing the leaking or oozing of the hair treatment composition (15) and thus the formation of blobbing which results in the deposition of an excessive amount of hair treatment composition (15) onto the hair, especially close to the roots. Such blobs of hair treatment composition (15) may also bleed across other hair strands causing unacceptable and unsightly treatment in neighbouring strands or ooze outside the application device (1). Furthermore, the hair treatment composition (15) may reach the scalp causing skin irritation.

The second zone (50) is an area free of said absorbent substrate (40). Said second zone (50) is an area on the internal surface (101) of said at least first plate (10) which is preferably adjacent to said first zone and comprises void space, a porous compressible material, a porous non-compressible material, a non-porous compressible material, a non-porous non-compressible material, at least one tine, at least one bristle or combination thereof.

The presence of an area free of absorbent substrate (40) allows for the management of said hair treatment composition (15) when the first and second plates (10; 20) are brought into juxtaposed relationship to apply the hair treatment composition (15) to the hair.

Porous compressible and/or non-compressible materials may help in preventing the hair treatment composition to ooze or leak out from the hair treatment application device (1) when the same is brought into a closed state. Furthermore, those materials may accommodate greater amount of hair treatment composition (15), thus increasing the volume of hair treatment composition that can be loaded into the hair treatment application device (1).

Non-porous compressible and non-compressible materials may help as well in preventing the hair treatment composition (15) to ooze or leak out from the hair treatment application device (1), but in particular those materials may help to stop or heavily reduce the movement of hair treatment composition (15) within the hair treatment application device (1).

Non-compressible materials, including tines, may help the user to avoid over-compressing the plates (10; 20) and thus, may act as an effective stop mechanism.

Bristles may help to disentangle the hair strands when the hair bundle to be treated is contacted with the hair treatment application system according to the invention.

Within the scope of the present invention are also included the combination of these materials within the second zone (50).

Figure 2:
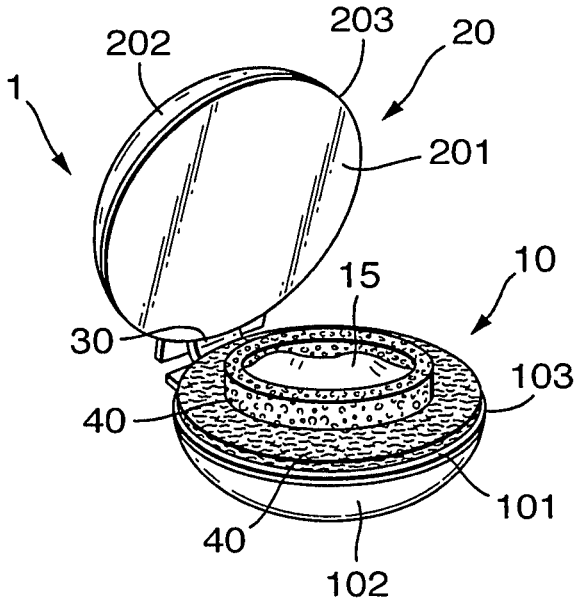
FIG. 2 shows the perspective view of an embodiment of the hair treatment application device (1) according to the invention. The hair treatment application device (1) comprises a first (10) and second (20) plate coupled together via a hinge (30). Each plate (10; 20) comprises an internal (101; 201) and external (102; 202) surface and a perimeter edge (103; 203). Two distinct concentric strips of absorbent substrates (40) are attached to the first zone of the internal surface (101) of the first plate (10). The most inward extending absorbent substrate is higher than the one extending at the perimeter edge (103). The second zone, free of absorbent substrate, is occupied by a hair treatment composition (15). The second zone is not visible.
Figure 3:
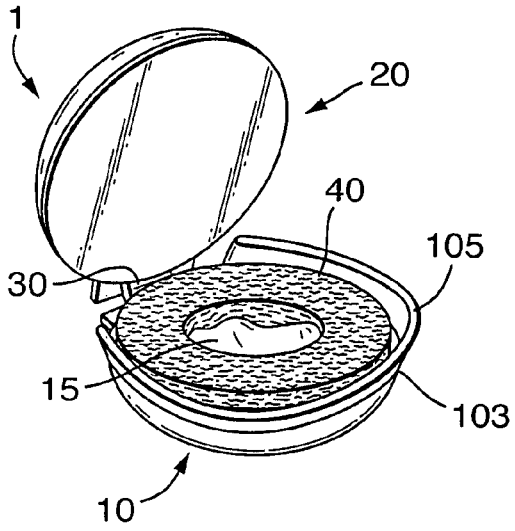
FIG. 3 shows the perspective view of another embodiment of the hair treatment application device (1) according to the invention. The first (10) plate of the hair treatment application device (1) is connected to the second (20) plate via a hinge (30). The first zone on the first plate comprises a strip of absorbent substrate (40), which extends along the perimeter edge (103) of the first plate. The second zone, free of absorbent substrate is occupied by a hair treatment composition (15). The lateral side of the absorbent substrate (40) is partially covered by an impervious membrane (105). The second zone is not visible.

In certain embodiments, at least one absorbent substrate (40) of said first zone may extend as a continuous strip along the perimeter edge (103) of said first plate (10) as shown in FIGS. 1, 2 and 3. In these particular embodiments the absorbent substrate (40) may have a length of from about 1.00 cm to about 80.00 cm, preferably from about 3.00 cm to about 50.00 cm and more preferably from about 6.00 cm to about 30.00 cm. The absorbent substrate (40) may be of constant or variable width. The absorbent substrate (40) may be continuous or discontinuous; by continuous it is meant that the absorbent substrate (40) does not form loci or islets or it is not interrupted. Preferably the absorbent substrate (40) is continuous. When the absorbent substrate (40) is continuous, said absorbent substrate (40) has a width of from about 0.05 cm to about 4.00 cm, preferably from about 0.10 cm to about 3.00 cm, more preferably from about 0.50 cm to about 2.50 cm. When the absorbent substrate (40) is discontinuous it has a width of from about 0.00 cm to about 4.00 cm, preferably from about 0.00 cm to about 3.00 cm, more preferably from about 0.00 cm to about 2.50 cm, wherein the absorbent substrate (40) has a width of about 0.00 cm where the absorbent substrate (40) is absent. When the absorbent substrate (40) is discontinuous, at least some portion has a width of at least 0.05 cm, preferably at least 0.10 cm, more preferably at least 0.50 cm.

In some preferred embodiments, at least one absorbent substrate (40) extends as a continuous strip on said internal surface (101), upward from said internal surface (101) and said continuous strip defines an area on said internal surface (101) of said first plate (10) where the hair treatment composition (15) may be loaded. Some examples of these embodiments are shown in FIGS. 1, 2 and 3. The geometry of the absorbent substrate (40) may help to indicate to the user where to load the hair treatment composition (15) and/or the correct amount of hair treatment composition (15) to be loaded into said hair treatment application device (1).

In certain embodiments at least a portion of the outer side of said absorbent substrate (40) may comprise an impervious membrane (105) as shown in FIG. 3. Preferably the lateral side of said absorbent substrate (40) comprises an impervious membrane (105). Materials suitable for an impervious membrane include polyethylene, polypropylene or polyethylene terephthalate, silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate, polystyrene, or copolymers or electro-static flocking or sealed non-woven or sealed foam structures.

Figure 4:
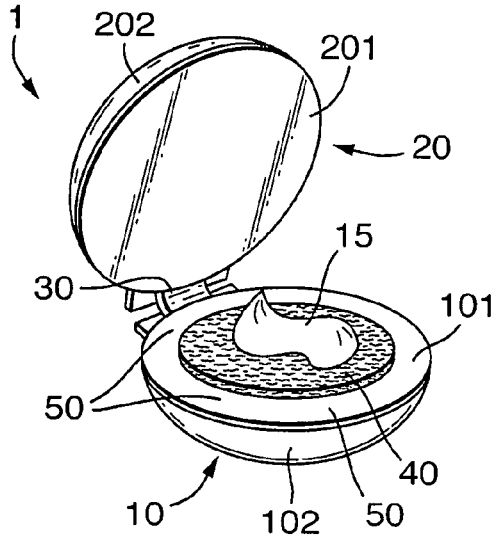
FIG. 4 is the perspective view of a hair treatment application device (1) according to the invention, wherein a first (10) and second (20) plate are connected together via a hinge (30). Each plate (10; 20) has an internal (101; 201) and external (102; 202) surface. The first zone comprising an absorbent substrate (40) is substantially centrally located on the internal surface (101) of said first (10) plate. A hair treatment composition (15) is loaded on said absorbent substrate (40). The second zone (50) circumscribes said absorbent substrate (40).

In certain embodiments, one of which is shown in FIG. 4, the first zone is substantially centrally located on the internal surface (101) of said first plate (10). The second zone (50) is free of any materials and may circumscribe the entire absorbent substrate (40) of the first zone.

Figure 5:
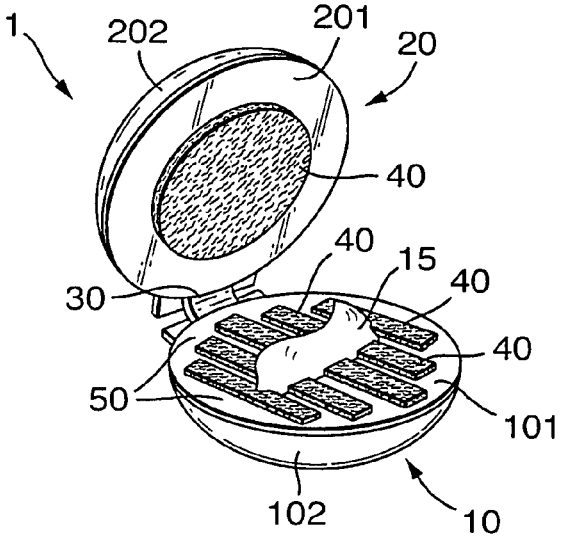
FIG. 5 is the perspective view of an embodiment of the present invention showing a hair treatment application device (1) comprising a first (10) and second (20) plate connected via a hinge (30). Each plate (10; 20) has an internal (101; 201) and external (102; 202) surface. The first plate (10) comprises a first zone where rectangular strips of absorbent substrate (40) are attached. The hair treatment composition (15) is loaded over the absorbent substrates (40). The second plate (20) comprises also an absorbent substrate (40) within the specification of the present invention. The second zone (50) circumscribes said rectangular strips of absorbent substrate (40).
Figure 6:
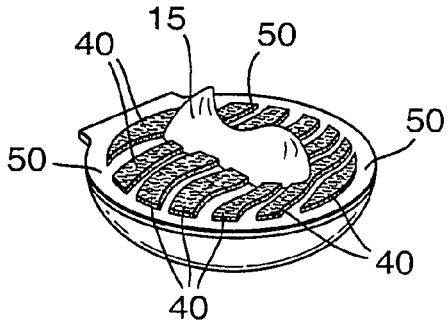
FIG. 6 shows the perspective view of the first plate (10) of another embodiment of the present invention. The first zone of said first (10) plate has attached multiple wave-shaped absorbent substrates (40). A hair treatment composition (15) is loaded into the absorbent substrates (40). The second zone (50) circumscribes said multiple wave-shaped absorbent substrates (40).

In certain other embodiments, the first zone may comprise multiple absorbent substrates (40) which are attached to the internal surface (101) of said fist plate (10) as shown in FIGS. 5 and 6. In FIG. 5, rectangular-shaped absorbent substrates (40) are positioned over the internal surface (101) of said first plate (10). The shape and size as well as the type of the absorbent substrates (40) may vary. In certain other embodiments the absorbent substrate (40) may have various shapes such as star, heart, flower, cross or other shapes easily recognizable by the consumer. The shape or the arrangement of multiple absorbent substrates (40) may form patterns such as ethnic patterns, oriental characters such as ideograms and similar patterns. In particular FIG. 6 shows an embodiment of the present invention where multiple wave-shaped absorbent substrates (40) are attached on the first zone of said internal surface (101) of said first plate (10). In FIGS. 5 and 6, the second zone (50) is free of any materials and circumscribes said multiple rectangular or wave-shaped absorbent substrates (40) of the first zone.

In the embodiment shown in FIGS. 1, 2, 3 and 4, the second plate (20) is unoccupied of any additional feature, but within the scope of the present invention are also considered embodiments having attached on the internal surface (201) of said second plate porous and/or non porous, compressible and/or non-compressible materials, tines or bristle, comb like structures and other optional features as described herein after. The second plate (20) may be the mirror image of said first plate (10). In particular FIG. 5 shows an embodiment where both the internal surfaces (101; 201) have a first zone where an absorbent substrate (40) within the scope of the present invention is attached.

4. Absorbent Substrate and Other Materials

Suitable absorbent substrates for use in the present invention may be selected from non-wovens; wovens; porous foams and foam materials; porous plastics; flexible frits; meshes; and combinations thereof including recycled and composite materials having one or more plies of the same or different materials superimposed physically, joined together continuously (laminated), in a discontinuous pattern, or by bonding the external edges at discrete loci provided that the structures meet the functional requirements described hereinabove.

The absorbent substrates of the present invention are preferably selected from non-wovens and/or porous foams.

Non-woven materials are produced from fibers that may be staple or continuous filaments or be formed in situ and include a manufactured sheet, web or batt or directionally or randomly oriented fibers, bonded by friction, and/or cohesion and/or adhesion. Nonwoven webs and processes for making them may comprise three steps: fiber laying, precursor web formation, and fiber bonding. The fiber laying step may be comprised of the spunlaying, meltblowing, carding, airlaying, wetlaying and combinations thereof, of the fibers comprising the web onto a forming surface. The step of precursor web formation may prevent the fibers comprising the web from coming apart during the bonding step. Precursor web formation may be performed via a pre-bonding step, such as one that is chemical or mechanical in nature. The bonding step may then impart strength to the finished web. The bonding step may be comprised of subjecting the fibers comprising the web to hydroentanglement (HET), cold calendering, hot calendering, air through bonding, chemical bonding, needle punching, and combinations thereof. Suitable non-woven materials may be comprised of natural or synthetic fibers selected from acetate fibers; acrylic fibers; cellulose ester fibers; modacrylic fibers; polyamide fibers; polyester fibers; polyolefin fibers; polyvinyl alcohol fibers; rayon fibers; keratin fibers; cellulose fibers; silk fibers and combinations thereof. The non-wovens may be comprised of mono-component fibers, such as a polyolefin or polyester, or bi-component fibers, such as a sheath/core fiber or side by side fiber of polyethylene/polypropylene or polyethylene/polyester, or bi-constituent fibers comprised by a blend of two or more thermoplastic polymers.

The preferred non-woven substrates are selected from Carded, Air-laid, and Meltblown non-woven materials or composites. More preferably, the non-woven substrates of the present invention are selected from Carded webs produced by a carding machine with one of more different types of fibres. Even more preferably, the non-woven substrates of the present invention are selected from multi-layer or lofty web which are consolidated by through air bonding or needle-punching, often referred to as batting battings. Examples of suitable Carded non-wovens for use herein include; Libeltex Thermo-contact 01-766 DI-8; Libeltex Loftfill HC2; PGI FB-215; PGI FB-204B, PGI FB-185 and PGI FB-217.

Porous foams and foam materials are made from low density elastomers, plastics, and other materials with various porosities and may be selected from open cellular foams; flexible foams; rigid foams; and reticular foams and syntactic foams which can be fabricated into finished shapes using molding, casting, extrusion, pultrusion, machining, thermal forming, plastic welding, blow molding, rapid prototyping techniques, grinding and/or other specialized processes. The porous foams and foam materials may be composed of a variety of chemical systems including acrylonitrile-butadiene-styrene (ABS); acrylics; epoxy resins; fluoropolymers; isoprene-styrene (SIS) and styrene-butadiene-styrene (SBS); synthetic rubbers or elastomers based on a variety of systems such as silicone, polyurethane and neoprene; nitrile rubbers; plastics or elastomers formed from natural or plant-based raw materials such as natural rubber (polyisoprene) or vulcanized fibre; water-based and water-borne resins and latex materials. Chemical systems for porous foams and foam materials may include ethylene copolymer, expanded polyethylene, polycarbonate, polyester, polyether, polyetherimide, polyimide, polyolefin, polypropylene, polyurethane, phenolic, polyurea, and vinyl.

Porous plastics can be made from wide variety of materials including Polytetrafluoroethylene (PTFE), Polyethylene (PE), Polypropylene (PP), and Polyvinyldifluoride (PVDF). They are created by filling a mold with tiny plastic pellets, subjecting the mold to heat and pressure so the pellets bond where they touch. This part is then heated outside the mold; the part shrinks significantly during this step which strengthens it.

The porous foams are preferably polyurethane foams. Suitable examples of porous foams are available from Recticel International (Belgium) and include Sweepex S 31 CS/R, Bulpren S28280, Bulpren D32133, Filtren T23220, and Filtren TM 23133.

The absorbent substrate (40) can be attached in any suitable method to the internal surface (101; 201) of said plates (10; 20) providing that said method does not destroy or alter the performance of the absorbent substrate (40). Useful methods are, but not limited to, heat welding including pressure, ultrasonic forces, radio or high frequencies, co-extruded heat activated adhesives, electro static adhesions such as flocking by fibres. The absorbent substrate (40) may also be attached to the application device (1) through adhesive, including two-side tape, thermo-set, hot melt and cold seal, adhesion or extrusion lamination. Mechanical interlock or entanglement such as Velcro®, clamping, snap locks, sealing beads, locking pins and magnetism may also be used to adhere the material to the application device (1).

Finally, the absorbent substrates (40) according to the invention are preferably substantially inert to the hair treatment compositions (15).

Suitable porous compressible or non-compressible materials for further additional zones may be selected from non-wovens; wovens; porous foams and foam materials; porous plastics; flexible frits; meshes; sponges and combinations thereof including recycled and composite materials having one or more plies of the same or different materials superimposed physically, joined together continuously (laminated), in a discontinuous pattern, or by bonding the external edges at discrete loci provided that the structures meet the functional requirements described hereinabove.

Useful non-porous compressible material comprises materials such as silicone or natural and synthetic rubbers, thermo plastic elastomer, thermo plastic vulcanate or copolymers. Suitable thermoplastic materials include polyolefins, polyethylene terepthalate, polyvinylidene chloride, and polystyrene. Suitable examples include, but are not limited to, ethylene-propylene diene monomer rubbers such as Santoprene® sold by Monsanto, Inc. of St. Louis, Mo.; halogenated polyolefins such as Alcryn sold by DuPont Polymer Products of Wilmington, Del.; hydrogenated adduct of a styrene-butadiene block copolymer with maleic anhydride, such as Craton sold by Shell Chemical Company of Houston, Tex.; SEBS (sequenced styrene-ethylene-butadiene) polymers. Other materials could be used including polyvinylchloride, polyamide, acetyl, acrylonitrile butadiene styrene, acrylic, acrylonitrile styrene acrylate or ethylene vinyl alcohol.

Suitable materials for a bristle are synthetic material such as polyethylene, polypropylene or polyethylene terephthalate, silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate, polystyrene, or copolymers or electro-static flocking or non-woven or foam structures or natural sources such as Horse Hair. The wire form of the bristles or brushes may be straight, curved or crimped to achieve the required performance.

Suitable materials for the tines include polyethylene, polypropylene or polyethylene terephthalate, silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate, polystyrene, or copolymers or electro-static flocking or non-woven or foam structures.

The materials described above can be co-injected, over moulded, in-mold assembled, or attached by adhesion lamination, heat bonding and they may be removable or permanently attached. Any methods suitable to attach these materials to the application device (1) may be employed herein providing that said method does not destroy or alter the performance of said material. Useful methods are, but not limited to, heat welding including pressure, ultrasonic forces, radio or high frequencies, co-extruded heat activated adhesives, electro static adhesions such as flocking by fibres. These materials comprised in the second zone may also be attached to the application device (1) through adhesive, including two-side tape, thermo-set, hot melt and cold seal, adhesion or extrusion lamination. Mechanical interlock or entanglement such as Velcro®, clamping, snap locks, sealing beads, locking pins and magnetism may also be used to adhere the material to the application device (1).

5. Hair Treatment Composition

As discussed hereinabove, the inventors have surprisingly determined that the viscosity of the hair treatment composition (15) must be selected in combination with the other essential features of the present invention in order to provide the expected technical effect. Accordingly it has been surprisingly found that for effective application of the hair treatment composition (15), said at least one hair treatment compositions (15) has a viscosity of from about 3,000 cPs to about 150,000 cPs, preferably from about 5,000 cPs to about 125,000 cPs, more preferably from 7,000 cPs to about 100,000 cPs, even more preferably from about 9,000 cPs to about 85,000.

The viscosity of the hair treatment composition (15) is measured before the hair treatment composition (15) is loaded into the hair treatment application device (1). The viscosity is measured for liquid hair treatment compositions (15) only. The term liquid hair treatment composition as used therein means a liquid form of a hair treatment composition (15) such as paste, gel, solutions water-in-oil emulsions or other suitable forms, provided that they are in the form of a liquid when delivered to head and that have viscosity within the range claimed herein. Preferably the compositions are applied in the form of gels which provide good adhering properties. Hydrogels are especially preferred as they provide a source of water that facilitates diffusion and absorption of the hair treatment compositions (15) within the absorbent substrate (40) of the application device (1).

According to the present invention, there are a number of ways to provide the desired hair treatment composition (15) mixture:

When two identical hair treatment compositions (15) are loaded independently and then mixed within said hair treatment application device (1), the viscosity of the hair treatment composition (15) is measured before loading one of said hair treatment composition (15) onto said hair treatment application device (1).

When two different hair treatment compositions (15) are premixed before loading into said hair treatment application device (1), the viscosity is measured on the resulting mixed hair treatment composition (15) before said mixed hair treatment composition is loaded into said hair treatment application device (1).

When two (or more) different hair treatment compositions (15) are independently loaded into said applicator device (1) and then mixed within said hair treatment application device (1), the viscosity of each single hair treatment compositions (15) is measured before loading into said hair treatment application device (1). For embodiments involving the loading of two different compositions into said hair treatment application device (1), which are subsequently mixed within the said hair treatment application device (1), it is preferred that the viscosity of the resulting mixed hair treatment composition (15) has a viscosity of from about 3,000 cPs to about 150,000 cPs. For such embodiments, the viscosity of the resulting mixed hair treatment compositions (15) is determined by mixing the two (or more) hair treatment compositions (15) prior to loading into said hair treatment application device (1) as described hereinafter in the test method section.

When one of the hair treatment compositions (15) is a powder, then the viscosity of the hair treatment composition (15) resulting from the mixing of said powder with another liquid hair treatment composition (15) is measured.

It is also believed that for some hair treatment compositions (15) it is desirable to have a high degree of shear thinning rheology to facilitate non-messiness, good performance, and a precise application of the hair treatment composition (15) only within the selected hair strand avoiding cross-contamination to the rest of the hair.

6. Types of Hair Treatment Compositions

Any hair treatment composition (15) characterized by having the viscosity within the ranges selected herein can be employed in the underlying invention and can be loaded in the selected absorbent substrates (30) to achieve the technical effect described above. Examples of hair treatment compositions (15) that may be applied to the absorbent substrate(s) (30) are discussed below. Suitable hair treatment compositions (15) include shampoos, conditioners, styling compositions, hair colourants, bleaches, and highlighting compositions.

Accordingly, the compositions may comprise components known, conventionally used, or otherwise effective for use in hair treatment compositions (15) particularly oxidative bleaching and dye compositions which include but are not limited to: developer dye compounds; coupler dye compounds; direct dyes; oxidizing agents; thickeners; chelants; pH modifiers and buffering agents; carbonate ion sources and radical scavenger systems; anionic, cationic, nonionic, amphoteric or zwitterionic surfactants, or mixtures thereof; anionic, cationic, nonionic, amphoteric or zwitterionic polymers, or mixtures thereof, fragrances; dispersing agents; peroxide stabilizing agents; proteins and derivatives thereof, plant materials (e.g. aloe, chamomile and henna extracts); silicones (volatile or non-volatile, modified or non-modified), film-forming agents, ceramides, preserving agents, colour indicators and opacifiers. Some adjuvants referred to above, but not specifically described below, which are suitable are listed in the International Cosmetics Ingredient Dictionary and Handbook, (8th ed.; The Cosmetics, Toiletry, and Fragrance Association). Particularly, vol. 2, sections 3 (Chemical Classes) and 4 (Functions) are useful in identifying specific adjuvants to achieve a particular purpose or multipurpose.

A. Solvents

The medium suitable for dyeing may be selected from water or a mixture of water and at least one organic solvent to dissolve the compounds that would not typically be sufficiently soluble in water. Suitable organic solvents for use herein include, but are not limited to: C1 to C4 lower alkanols (e.g., ethanol, propanol, isopropanol), aromatic alcohols (e.g. benzyl alcohol and phenoxyethanol); polyols and polyol ethers (e.g., carbitols, 2-butoxyethanol, propylene glycol, propylene glycol monomethyl ether, diethylene glycol monoethyl ether, monomethyl ether, hexylene glycol, glycerol, ethoxy glycol), and propylene carbonate. Organic solvents are typically present in an amount ranging from about 1% to about 30%, by weight, of the composition. Preferred solvents are water, ethanol, propanol, isopropanol, glycerol, 1,2-propylene glycol, hexylene glycol, ethoxy diglycol, and mixtures thereof.

B. Oxidative Dye Compounds

The compositions of the present invention may include oxidative dye compounds in the form of primary intermediates or couplers. The compounds suitable for use in the inventive compositions (including those optionally added), in so far as they are bases, may be used as free bases or in the form of their physiologically compatible salts with organic or inorganic acids, such as hydrochloric.

Optional couplers are typically present in an amount such that in aggregate the concentration of couplers and the present discrete particle aggregates and/or agglomerates in the composition ranges from about 0.002% to about 10%, preferably from about 0.01% to about 5%, by weight, of the hair dyeing composition. Optional primary intermediates are present in an effective dyeing concentration, typically an amount from about 0.001% to about 10%, preferably from about 0.01% to about 5%, by weight, of the hair dyeing composition. The total amount of dye compounds in the hair dyeing compositions of this invention will typically range from about 0.002% to about 20%, preferably from about 0.04% to about 10%, more preferably from about 0.1% to about 7%, by weight, of the hair dyeing composition.

These compounds are well known in the art, and include aromatic diamines, aminophenols, aromaticdiols and their derivatives (a representative but not exhaustive list of oxidation dye precursor can be found in Sagarin, "Cosmetic Science and Technology", "Interscience, Special Edn. Vol. 2 pages 308 to 310). It is to be understood that the precursors detailed below are only by way of example and are not intended to limit the compositions and processes herein. Toluene-2,5-diamine, p-phenylenediamine, n-phenyl-p-phenylenediamine, resorcinol, 4- chlororesorcinol, m- aminophenol, p- aminophenol, 1-naphthol, 1,5- naphthalenediol, 2,7-naphthalenediol, p-methylaminophenol, hydroxybenzomorpholine, 4-amino-2-hydroxytoluene, 2-methyl-5-hydroxyethylaminophenol, 1,2,4- trihydroxybenzene, phenyl methyl pyrazolone, 2,4-diaminophenoxyethanol, 3-amino-2,4-dichlorphenol, 2-methylresorcinol, n,n-bis(2-hydroxyethyl)-p-phenylenediamine, 2,4,5,6-tetraminopyrimidine, 4-amino-m-cresol, 6-amino-m-cresol, 1,3-bis-(2,4-diaminophenoxy)-propane, hydroxyethyl-p-phenylene diamine, 2-amino-4-hydroxyethylaminoanisole, 5-amino-6-chloro-o-cresol, hydroxyethyl-3,4-methylenedioxyaniline, 2,6-dihydroxy-3,4-dimethylpyridine, 2,6-dimethoxy-3,5-pyridinediamine, dihydroxyindole, 5-amino-4-chloro-o-cresol, hydroxypropyl-bis-(n-hydroxyethyl-p-phenylenediamine), 6-hydroxyindole, isatin, 3-amino-2- methylamino-6-methoxypyridine, 2- amino-3- hydroxypyridine, 2,6- dihydroxyethylaminotoluene, 2,5,6-triamino-4- pyrimidinol, dihydroxyindoline, 1-acetoxy-2-methylnaphthalene, 1-hydroxyyethyl-4,5- diaminopyrazole, 2,2'-methylenebis-4-aminophenol, 2-methyl-1- naphthol, 4-formyl-1-methylquinolinium-p-toluenesulfonate. These can be used in the molecular form or in the form of peroxide-compatible salts.

The hair colouring compositions of the present invention may also include non oxidative hair dyes. i.e. direct dyes which may be used alone or in combination with the above described oxidative dyes. Suitable direct dyes include azo or anthraquinone dyes and nitro derivatives of the benzene series and or melanin precursors and mixtures thereof. Such direct dyes are particularly useful to deliver shade modification or highlights. Particularly preferred are Basic Red 51, Basic Orange 31, Basic Yellow 87 and mixtures thereof.

C. Alkalizing Agent

According to the present invention the composition may also comprise at least one source of alkalizing agent. Any agent known in the art may be used such as alkanolamides for example monoethanolamine, diethanolamine, triethanolamine, monopropanolamine, dipropanolamine, tripropanolamine, 2-amino-2-methyl-1, 3-propanediol, 2-amino-2-methyl-1- propanol, and 2-amino-2-hydroxymethyl-1,3-propanediol and guanidium salts, ammonium chloride, ammonium sulphate, ammonium nitrate, ammonium phosphate, ammonium acetate, ammonium carbonate, ammonium hydrogen carbonate, ammonium carbamate, ammonium hydroxide, percarbonate salts, ammonia, ammonium carbonate, ammonium carbamate, ammonia, sodium silicate, sodium metasilicate, sodium disilicate, ammonium persulfates, sodium persulfate, potassium persulfate and mixtures thereof.

The compositions of the present invention may comprise from about 0.1% to about 40% by weight, preferably from about 1.0% to about 35%, most preferably from about 2% to about 30% of an alkalizing agent, preferably ammonium ions.

D. Oxidizing Agent

The compositions may comprise an oxidizing agent, present in an amount sufficient to bleach melanin pigment in hair and/or cause formation of dye chromophores from oxidative dye precursors (including developers and/or couplers when present). Typically, such an amount ranges from about 1% to about 20%, preferably from about 3% to about 15%, more preferably from about 6% to about 12%, by weight, of the developer composition. Inorganic peroxygen materials capable of yielding hydrogen peroxide in an aqueous medium are preferred and include but are not limited to: hydrogen peroxide; inorganic alkali metal peroxides (e.g. sodium periodate and sodium peroxide); organic peroxides (e.g. urea peroxide, melamine peroxide); inorganic perhydrate salt bleaching compounds (e.g. ammonium persulfates, sodium persulfate, potassium persulfate and mixtures thereof). Preferred are hydrogen peroxide and persulphates. The persulfate powders may be mixed with another liquid hair treatment composition as described herein after or alternatively may be immobilized physically via applying the powder particles to the interior and/or exterior surface of the absorbent substrate in such a means that they are physically contained and do not exit the substrate easily under gravity. This can be achieved via a hollow pocket or reservoir within the absorbent substrate that contains the persulfate salt blend.

E. pH Modifiers and Buffering Agents

The compositions may further comprise a pH modifier and/or buffering agent in an amount that is sufficiently effective to adjust the pH of the composition to fall within a range from about 3 to about 13, preferably from about 8 to about 12, more preferably from about 8 to about 11. Suitable pH modifiers and/or buffering agents for use herein include, but are not limited to: ammonia, alkanolamides such as monoethanolamine, diethanolamine, triethanolamine, alkali metal and ammonium hydroxides and carbonates, preferably sodium hydroxide and ammonium carbonate, and silicates such as sodium silicate and sodium metasilcate, and ammonium chloride.

F. Carbonate Ion Source

The compositions of the present invention may further comprise in a preferred embodiment at least one source of peroxymonocarbonate ions, preferably formed in situ from a source of hydrogen peroxide and a carbonate ion source. According to the present invention the compositions thus also may comprise at least a source of carbonate ions or carbamate ions or hydrocarbonate ions or any mixture thereof. Any source of these ions may be utilized. Suitable sources for use herein include sodium, potassium, guanidine, arginine, lithium, calcium, magnesium, barium, ammonium salts of carbonate, carbamate and hydrocarbonate ions and mixtures thereof such as sodium carbonate, sodium hydrogen carbonate, potassium carbonate, potassium hydrogen carbonate, guanidine carbonate, guanidine hydrogen carbonate, lithium carbonate, calcium carbonate, magnesium carbonate, barium carbonate, ammonium carbonate, ammonium hydrogen carbonate and mixtures thereof. Percarbonate salts may also be utilized to provide both the source of carbonate ions and oxidizing agent. Preferred sources of carbonate ions, carbamate and hydrocarbonate ions are sodium hydrogen carbonate, potassium hydrogen carbonate, ammonium carbamate and mixtures thereof. The compositions of the present invention may comprise from about 0.1% to about 15%, preferably from about 0.1% to about 10% by weight, more preferably from about 1% to about 8% by weight of the carbonate ion.

G. Radical Scavenger System

The compositions may comprise a radical scavenger, in a sufficient amount to reduce damage to the hair during the coloring process. Typically, such an amount will range from 0.1% to 10%, preferably from 1% to 7%, by weight of the composition. The radical scavenger is preferably selected such that it is not an identical species as the alkalizing agent. The radical scavenger is a species that can react with a carbonate radical to convert the carbonate radical by a series of fast reactions to a less reactive species. Preferred radical scavengers may be selected from the classes of alkanolamines, amino sugars, amino acids and mixtures thereof, and may include, but are not limited to: monoethanolamine, 3-amino-1-propanol, 4-amino-1-butanol, 5-amino-1-pentanol, 1-amino-2-propanol, 1-amino-2-butanol, 1-amino-2-pentanol, 1-amino-3-pentanol, 1-amino-4-pentanol, 3-amino-2-methylpropan-1-ol, 1-amino-2-methylpropan-2-ol, 3-aminopropane-1,2-diol, glucosamine, N-acetylglucosamine, glycine, arginine, lysine, proline, glutamine, histidine, serine, tryptophan and potassium, sodium and ammonium salts of the above and mixtures thereof. Other preferred radical scavenger compounds include benzylamine, glutamic acid, imidazole, di-tert-butylhydroxytoluene, hydroquinone, catechol and mixtures thereof.

H. Chelants

The compositions may comprise chelants in an amount sufficient to reduce the amount of metals available to interact with formulation components, particularly oxidizing agents, more particularly peroxides. Typically such an amount will range from at least about 0.25%, preferably at least about 0.5%, by weight, of the composition. Suitable chelants for use herein include but are not limited to: diamine-N,N'-dipolyacid, monoamine monoamide-N,N'-dipolyacid, and N,N'-bis (2-hydroxybenzyl)ethylenediamine-N,N'-diacetic acid chelants (preferably EDDS (ethylenediaminedisuccinic acid)), carboxylic acids (preferably aminocarboxylic acids), phosphonic acids (preferably aminophosphonic acids) and polyphosphoric acids (in particular straight polyphosphoric acids), their salts and derivatives.

I. Humectants

The compositions may comprise humectants. Typically the amount of humectants in the hair treatment composition will range from at least about 1 to about 50%, preferably from about 5 to about 40%, and more preferably from about 10 to about 30%, by weight, of the composition. Suitable humectants for use herein include but are not limited to: polyhydric alcohols such as glycerin, polyethylene glycol, and propylene glycol, and mixtures thereof.

J. Thickening Agents

The hair treatment composition may further comprise a thickening agent. The thickening agent is present at a level of from about 0.01% to about 20%, preferably from about 0.1% to about 10%, more preferably from about 0.3% to about 5%, and even more preferably from about 0.5% to about 3%, by weight of the composition.

Gel network thickener system may be used as thickening agent for the purpose of the present invention. The gel network thickener system comprises at least one low HLB surfactant or amphophile having high melting point and at least one additional second surfactant.

The low HLB surfactant or amphophile has an HLB of 6 or less and a melting point of at least 30° C. Representative examples include following compounds (in the examples below "solid" refers to material state at temperature below 30° C.): solid fatty alcohols, solid oxyethylenated fatty alcohols, solid glycol esters, solid oxyethylenated alkyl phenols, solid sorbitan esters, solid sugar esters, solid methyl glucoside esters, solid polyglycerine esters, solid alkyl glyceryl ethers, solid propylene glycol fatty acid esters, cholesterol and ceramides. Preferably the low HLB surfactants are selected from linear or branched fatty alcohols comprising from about 14 to 30 carbon atoms, oxyethylenated fatty alcohols comprising from about 16 to 30 carbon atoms and at most about 2 units of ethylene oxide and glycerol mono esters of fatty acids comprising from about 16 to 30 carbon atoms. Most preferably the low HLB surfactants include cetyl, stearyl, cetostearyl or behenyl alcohols, steareth-2 and glycerol monostearate.

The second surfactant of the gel network thickener system may be anionic, non-ionic or cationic. Examples of anionic surfactants include, but are not limited to those of the formula RnXmYM, wherein R is a alkyl, alkenyl or alkylaryl group having from 8 to 30 carbon atoms, X is a polar group comprising at least one carbon atom and at least one oxygen or nitrogen atom, Y is an anionic group selected from carboxylates, sulphates, sulphonates or phosphates, n and m are independently 1 or 2 and M is hydrogen or a salt forming cation and mixtures thereof. Examples of non-ionic surfactants include those having an HLB of 7 or more and comprising one or more polyethyleneoxide chains wherein each polyethyleneoxide chain contains on average at least about 50 ethylene oxide units. Also suitable for use as nonionic surfactants are non-ionic surfactants having an HLB of 7 or more which are free of polyethyleneoxide chains. Examples of cationic surfactants include, but are not limited to quaternary ammonium salts or amido-amines having at least one fatty chain comprising from 8 to 30 carbon atoms and mixture thereof. The quaternary ammonium salts have general formula N+ (R1R2R3R4) X−, wherein, R1 is selected from linear and branched radicals comprising about 12 to 30 carbon atoms, R2 is selected from linear and branched radicals comprising about 12 to 30 carbon atoms or the same group as radicals R3 to R4, the radicals R3 to R4, which may be identical or different, are selected from linear and branched aliphatic radicals comprising from about 1 to 4 carbon atoms, and aromatic radicals such as aryl and alkylaryl, the aliphatic radicals may comprise at least one hetero atom such as oxygen, nitrogen, sulphur and halogens, the aliphatic radicals are chosen, for example, from alkyl, alkoxy and alkylamide radicals, and wherein X− is an anion selected from halides such as chloride, bromide and iodide) (C2-C6)alkyl sulphates, such as methyl sulphate, phosphates, alkyl and alkylaryl sulphonates, and anions derived from organic acids, such as acetate and lactate. The cationic surfactant is selected from, for example, a behentrimonium chloride, behenamidopropyltrimonium methosulfate, stearamidopropyltrimonium chloride, arachidtrimonium chloride and mixtures thereof. The amidoamine have general formula R'1-CONH(CH2)nNR'2R'3: wherein, R'1 is selected from linear and branched radicals comprising about 12 to 30 carbon atoms, the radicals R'2 and R'3, which may be identical or different, are selected from hydrogen, linear and branched aliphatic radicals comprising from about 1 to 4 carbon atoms, and aromatic radicals such as aryl and alkylaryl, the aliphatic radicals may comprise at least one hetero atom such as oxygen, nitrogen, sulphur and halogens, the aliphatic radicals are chosen, for example, from alkyl, alkoxy and alkylamide radicals, and wherein n is integer from 1 to 4. The amido-amine is selected from, for example, behenamidopropyldimethylamine, stearamidopropyldimethylamine, and mixtures thereof.

More than one surfactant of the above specified types or any combination of the surfactants can be used and the weight ratio of the low HLB surfactants to the second specified surfactants is from about 100:1 to about 1:10, preferably from 20:1 to 1:2, and more preferably from 10:1 to 1:1.

Amide surfactants are also suitable thickening agents, preferably when mixed with a source of carbonate ions. The amide surfactants may be selected from polyoxyethylene amides or polyhydroxy amides. Polyoxyethylene amides are selected from compounds according to the formula R—(OCH2CH2)x-(OCH2)y-C(O)NH(CH2CH2O)z-H, wherein x is independently selected from 0 to 100, y is 0 or 1, z is independently selected from 1 to 100, and R is independently selected from alkyl, alkenyl or alkylaryl groups having from 8 to 30 carbon atoms or is a polyhydroxy amide according to the formula:

Worm-like micelle phase thickening systems may also be suitable thickening agents for the purpose of the present invention. The worm-like micelle thickening system of the present invention is defined as a thickening system comprising at least one ionic surfactant and an electrolyte source of counter-ions for said ionic surfactant. Suitable ionic surfactants for use herein may be selected from anionic surfactants, cationic surfactants and or mixtures thereof.

Suitable thickening agents for use herein also include synthetic polymers such as cellulose derivatives (e.g. methylcellulose, carboxymethylcellulose, hydroxyethylcellulose, hydroxypropylcellulose, hydroxy-propylmethylcellulose, etc.), carbomer polymers (e.g. crosslinked polyacrylic acid copolymer or homopolymer and copolymers of acrylic acid cross linked with a polyalkenyl polyether), hydrophobically modified polyacrylic acid polymers, natural and synthetic gums, karaya gum, guar gum, gelatin, algin, sodium alginate, tragacanth, chitosan, polyethylene oxide, acrylamide polymers, polyacrylic acid, polyvinyl alcohol, polyamines, polyquarternary compounds, ethylene oxide polymers, polyvinylpyrrolidone, cationic polyacrylamide polymers, and mixtures thereof.

Other associative thickening agents include Rohm and Haas (such as Acrysol® ICS-1 and Aculyn® 22 and 28 thickeners, which are hydrophobically modified alkali-soluble acrylic polymer emulsions and Aculyn® 44 and 46 thickener, which is a hydrophobically modified nonionic polyol).

Preferred thickening agents are chosen from polymers (including gelling agents), gel phases referred to as creams or emulsions and combinations thereof.

A representative but not exhaustive list of polymers and thickening agents can be found in "The Encyclopaedia of Polymers and Thickeners for Cosmetics" compiled and edited by Robert Y. Lochhead, PhD and William R. Fron, Department of Polymer Science, University of Southern Mississippi.

Suitable gel phase referred to as creams or emulsions may be selected from cetyl alcohol, stearyl alcohol, fatty acids and mixtures thereof.

7. Additional Features

A detailed description of some additional features useful to be combined with the essential features according to the present invention is given below. These additional features may be optionally located on the internal (101; 201) or external (102; 202) surfaces of said first (10) and second (20) plates. Preferably, some of these features may be located on the internal surfaces (101; 201) of said plates (10; 20). Within the scope of the present invention are also conceived the combinations of the additional features described herein below within the same hair treatment application device (1).

7.1 Scraper

The hair treatment application device (1) may further comprise a scraper. A scraper is a continuous or discontinuous strip of non-porous material provided at the perimeter edge (103; 203) of at least one of said plates (10). Preferably, the scraper is continuous as shown in FIG. 3. The scraper wipes off the excessive deposition of hair treatment composition (15) when the first plate (10) is brought into juxtaposed relationship to said second plates (20) are and the hair treatment application device (1) is in a closed state. When the scraper is discontinuous, the scrapers repeat at regular or irregular interval along the perimeter edge (103) as to form a castellation configuration. In one embodiment the scrapers are present at the perimeter edges (103; 203) of both plates (10; 20) and the scrapers on the first plate (10) are alternated to the scrapers on the second plate (20) so that when the plates (10; 20) are brought into juxtaposed relationship the scrapers of both plates provide a continuous edge. The scraper comprises a non-porous compressible material. Useful non-porous compressible material comprises materials such as silicone or natural and synthetic rubbers, thermo plastic elastomer, thermo plastic vulcanate or copolymers. Suitable thermoplastic materials include polyolefins, polyethylene terepthalate, polyvinylidene chloride, and polystyrene. Suitable examples include, but are not limited to, ethylene-propylene diene monomer rubbers such as Santoprene® sold by Monsanto, Inc. of St. Louis, Mo.; halogenated polyolefins such as Alcryn sold by DuPont Polymer Products of Wilmington, Del.; hydrogenated adduct of a styrene-butadiene block copolymer with maleic anhydride, such as Craton sold by Shell Chemical Company of Houston, Tex.; sequenced styrene-ethylene-butadiene polymers. Other polymers could be used including polyvinylchloride, polyamide, acetyl, acrylonitrile butadiene styrene, acrylic, acrylonitrile styrene acrylate and ethylene vinyl alcohol.

7.2 Reservoirs

The hair treatment application device (1) may further comprise a reservoir for a hair treatment composition (15). The reservoir may be present on the external surface (102; 202) or internal surface (101, 201) of one or both plates. Preferably, the reservoir communicates with said absorbent substrate (40) in the internal surface (101) through apertures located through said plates (10). A valve may be located on the reservoir. In some embodiments, a one-way or a two-way valve may be incorporated into the internal surface (101; 201) of said first (10) and/or second (20) plates and/or in the reservoir to allow loading of the hair treatment composition (15) by engagement of a bottle, or any container suitable for dispensing the hair treatment composition. The reservoir may be fixed, attachable or removable from the plates (10; 20) and may be disposed of once the hair treatment compositions (15) have been released.

The reservoir may comprise materials such as polyethylene, polypropylene, polyethylene terephthalate, polyvinylchloride, silicone or natural and synthetic rubbers, thermo plastic elastomer, thermo plastic vulcanate or copolymers.

The reservoir can be formed in a number of ways including: co-injected, over moulding, in-mold assembly, vacuum forming, casting, adhesion lamination, or heat bonding of a laminate material.

The apertures may be covered by metering layers, barriers materials or liners removable via peeling, rupturing, puncturing, breaking, tearing, piercing, sliding, folding, and compression.

7.3 Stop Mechanism

One or more stop mechanisms may be incorporated onto at least one of the internal surfaces (101; 201) of said first and second plate (10; 20). The stop mechanism ensures that the hair treatment composition (15) may not be forced beyond the perimeter edge (103; 203) of said first and second plates (10; 20) when brought into juxtaposed relationship. In certain embodiments, the hair treatment application device (1) is brought into a closed state by applying pressure on the external surfaces (102; 202) of the plates (10; 20). When a too high pressure is exerted on the external surfaces (102; 202) of said first and second plates (10; 20) to bring the same into a juxtaposed relationship, the hair treatment composition (15) may bleed out from the hair treatment application device (1) or it may form blobs leading to unacceptable mess. Too high pressure may even cause damage of the absorbent substrate (40) comprised in the first zone and/or the materials comprised in said one or more additional zones affecting the application of the hair treatment composition (15) to the hair.

In certain embodiments, the stop mechanism may be manufactured during the same manufacturing step as the plates and with the same or different material.

The presence, size and height of the stop mechanism are related to the compressibility of the absorbent substrate (40) and the other materials used within said second zone. In certain embodiments the stop mechanism may be one or more tines or it may comprise teeth of a comb-like structure in any of the material described herein before. In certain embodiments the stop mechanism may be positioned within or below the absorbent substrate (40). In certain other embodiments, the stop mechanism may be incorporated at the perimeter edge (103; 203) of the first (10) and/or second (20) plate or on the internal surface (101; 201) in proximity of the connection (30). In certain other embodiments the stop mechanism may be integrated within connection (30) itself.

7.4 Hair Strand Selection Means

Consumers may use their fingers to select the hair strands on which they desire to apply the hair treatment composition. The hair treatment application device (1) of the present invention may however be further provided with hair strand selection means. Examples of hair strand selection means are, but not limited to hooks, such as crochet hooks and hair clips or hair beads. The hair strand selection means may be incorporated in one or both plates (10; 20). Said means may also be attached through a snap mechanism to the plates (10; 20) such that the hair strand selection means may swing from a position proximal to the plate to a far one, such as it happens with the blades of a penknife. The hair strand selection means may also be separately provided to the hair treatment application device (1) of the present invention as a component of a kit as described herein below.

7.5 Gripping Areas

Usually consumers wear gloves during the application of the hair treatment composition (15). The gloves are typically made from materials such as poly vinyl chloride or polyethylene or rubber materials such as isoprene, nyoprene or latex and may increase the difficulty for the consumers to grip the hair treatment application device (1). Thus, the hair treatment application device (1) disclosed herein may further comprise on the external surfaces (102; 202) of one or both plates (10; 20) gripping areas that are designed to provide grip. These gripping areas may be manufactured using co-injection or over-moulding techniques when the plates are manufactured. Useful materials include, but are not limited to, materials such as polyethylene, polypropylene or silicone or natural and synthetic rubbers, thermo plastic elastomer, thermo plastic vulcanate or copolymers. Other materials could be used including polyvinylchloride, polyamide, acetyl, acrylonitrile butadiene styrene, acrylic, acrylonitrile styrene acrylate, ethylene vinyl alcohol, polycarbonate and polystyrene, or electro-static flocking or non-wovens or foam structures. In addition, the gripping areas may be formed through embossing, debossing or coating of the external surfaces (102; 202) of one or both plates (10; 20). The gripping means can be located in only a portion of the external surface (102; 202) or they may cover the whole external surfaces (102; 202). Finally, the gripping areas may be a cavity present on the external surface (102; 202) of said plates (10; 20).

7.6 Release Liner or Barrier

Release liners or barriers may be present to protect the absorbent substrate (40) and/or the materials present in said second zone from contamination. The release liner or barrier may be peelable or resealable and may be constructed from a plastic, aluminium laminate constructions. Some examples of these materials include: laminates of low density polyethylene or blends of polyethylene with poly-isobutylene with aluminium foil and polyethylene terephthalate or bi-orientated polypropylene peel-able foils and may be made of a gas resistant material, especially for hair treatment composition comprising hydrogen peroxide, including aluminium laminated foil, metalised aluminium onto a plastic carrier, Aclar® polychloro-trifluoroethylene, polyvinylidene chloride, ethylene-vinyl alcohol copolymer, silica and aluminium oxides.

7.7 Means to Perform Loading of the Hair Treatment Composition into the Application Device One or more means suitable to attach, adapt or install a dispensing or loading device to perform the loading of the hair treatment composition (15) into the hair treatment application device (1) according to the invention may be present. Examples of said means are, but not limited to, nozzles and orifices, pouch pocket or one-way or two-way valves present on at least one plate (10) or through the connection (30). Said means may be permanently connected to the hair treatment application device (1) or may be removable, they may be disposable or recyclable and they may be provided as a separate component of a kit as described herein below.

8. Hair Treatment Composition Loading and Mixing

According to the present invention said one or more hair treatment compositions (15) may be loaded into the application device (1). One or more hair treatment compositions (15) may be applied either onto said absorbent substrate comprised into the first zone or into a depression or cavity of the plates (10; 20) as shown in FIG. 1. When the absorbent substrate (40) extends as a continuous strip along the perimeter edge (103) of said at least first plate (10) and upward from said internal surface (101) and wherein said continuous strip defines an area onto said internal surface (101) of said first plate (10), the hair treatment composition (15) may be loaded into said defines area as shown in FIGS. 2 and 3. When an optional reservoir is present the hair treatment composition (15) may be loaded into said reservoir through the one-way or two-ways valve.

The hair treatment composition (15) can be loaded into the hair treatment application device (1) by any means. In one embodiment the hair treatment composition (15) is loaded directly onto or into the absorbent substrate (40) by applying the hair treatment composition (15) for example from a bottle.

When the hair treatment compositions (15) require mixing and activation prior application to the hair, the single component of the hair treatment composition (15) may be mixed by shaking or stirring before loading or can be mixed during the loading procedure by employing specialized two or multi-chambered containers coupled with a static mixer. The mixing may also be performed by interposing an additional means capable of mixing two or more hair treatment compositions (15) or capable of mixing powders with water or other solvents to make a hair treatment composition (15). Said interposed means can also be provided with features to inject or load the mixed hair treatment compositions (15) onto the application device (1).

Once said one or more hair treatment compositions (15) are loaded into the hair treatment application device (1), the plates (10; 20) are brought into juxtaposed relationship once, preferably twice, more preferably more than twice to allow the hair treatment composition (15) to evenly distribute within the application device (1) and eventually to penetrate the porous absorbent substrate of the first zone.

The amount of hair treatment composition (15) applied on the application device (1) depends upon its size and capacity and the desired end results. The application device (1) may be preferably loaded with an amount of hair treatment composition (15) from about 0.5 gram to about 120 grams, more preferably from about 1 gram to about 50 grams, even more preferably from about 1.5 grams to about 25 grams of hair treatment composition (15).

9. Method of Use

The present invention also relates to a method to treat the hair by contacting the hair with the hair treatment application system according to the invention. Said hair treatment application device (1) may be pre-loaded with said one or more hair treatment composition (15), but preferably said hair treatment application device (1) is loaded with said at least one or more hair treatment compositions (15) before contacting the hair with said hair treatment application system. To allow even distribution of the hair treatment composition (15) within the porous absorbent substrate (40), said first (10) and second (20) plate of said hair treatment application device (1) are brought into juxtaposed relationship once, preferably twice, more preferably more than twice, before contacting the hair with said hair treatment application system. Once the hair treatment application system is ready to be used, the user holds through the external surfaces (102; 202) of said first and second plates (10; 20) the hair treatment application device (1) in one hand, preferably between the thumb and the index finger. Once the user has selected the hair strands to be treated, the application device (1) is positioned onto the hair strands, preferably at the root line while the hair treatment application device (1) is in an open state. The internal surfaces (101; 201) of the application device (1) are then clamped around the hair strands by bringing the plates (10; 20) into a juxtaposed relationship. By keeping the hair treatment application device (1) in this closed state, the user applies the hair treatment composition (15) by swiping the application device (1) along the entire length of the selected hair strands. The hair treatment composition (15) may also be applied only to limited areas of the hair, i.e. the user can coat only the root-line with the hair treatment composition (15). These steps, including the step of loading the application device (1) may be repeated more than once.

By contacting the hair with the hair treatment application system, the hair treatment composition (15) is delivered to the hair.

In certain embodiments, two or more hair treatment composition (15) needs to be mixed before to be applied to the hair. Preferably, said hair treatment compositions (15) are different and capable of reacting to form a mixed hair treatment composition.

Mixing can be performed prior loading of the hair treatment composition (15) into the hair treatment application device (1) and/or prior application of the hair treatment composition (15) onto the hair. In a preferred embodiment said one or more hair treatment composition (15) comprise a first and second hair treatment compositions and said first and second hair treatment compositions are mixed to form a third hair treatment composition. Said third hair treatment composition is loaded on said hair treatment application device (1) before contacting the hair with said hair treatment application system. In this preferred embodiment, said first hair treatment composition comprises an oxidizing agent, whereas said second hair treatment composition comprises an alkalizing agent. In a preferred embodiment, said oxidizing agent comprises hydrogen peroxide or said alkalizing agent comprises a component selected from the group of ammonium persulfate, sodium persulfate, potassium persulfate, sodium metasilicate, sodium silicate, ammonium chloride and mixtures thereof. When said first and second hair treatment compositions are mixed together, they form a highlighting composition.

The hair treatment compositions (15) according to the present invention are not intended to be applied to hair in a stationary manner but rather they are moved against the hair surface with the use of shear forces, i.e., swiping of individual hair strands, rubbing along root-line, rubbing into hair, wiping surface of hair, pulled through hair etc., thereby depositing the hair treatment composition (15) evenly along the entire length of the hair as required.

In embodiments where a release liner is present, the user peels off the release liner, loads the hair treatment composition (15) into said application device (1) and applies it to the hair. During the application one or more release liners can be resealed to protect the application device (1) and the hair treatment compositions (15) or to avoid contamination of the user's home furniture with the hair treatment composition (15).

In another embodiment a first hair treatment composition (15) is applied to the hair via any of the known conventional methods as a pre- or post-treatment to a second any further hair treatment composition (15) which can be applied via the hair treatment application device (1) according to the present invention.

In embodiments where a reservoir is present, the user may load the hair treatment composition (15) through any of the dispensing means and then the user may remove liners or barriers before applying the hair treatment composition to the hair. The user may mix the hair treatment compositions (15) before proceeding with the application by pressing the reservoir and pushing the hair treatment composition (15) contained therein to flow to the absorbent substrate (40) all the way through the apertures located through said first plate (10).

Finally, the application of the hair treatment composition (15) may occur on wet or dry hair and optionally, a rinsing or a shampooing step can be included between application of the first and second compositions to the hair.

10. Kits

The hair treatment application system according to the present invention may be provided as at least one hair treatment application system as a component of a kits. Additionally, the kits may comprise at least one or more individually packaged hair treatment compositions (15) comprising shampoo compositions, conditioning compositions, styling compositions, hair colourant compositions, hair bleaching, highlighting compositions or combination thereof. Additionally, more than one hair treatment application device (1) may be provided as component of the kits according to the present invention.

In one embodiment of the present invention, a first container may comprise oxidative dye precursors and an alkalizing agent, whereas a second container may comprise an oxidizing agent. In certain other embodiments of kits, a first container may comprise an ammonium ion source and a second container may comprise an oxidizing agent. Additional containers may be present in the kit, such as individually packaged composition comprising additional components such as oxidizing agents, conditioners, chelants, radical scavengers, solvents, direct dyes, shampoo, buffering agents, colouring agents thickeners, enzymes, anionic, non ionic, amphoteric and cationic surfactants, carriers, antioxidants, stabilizers, perfumes, masking fragrances, herb and plant extracts, pearlescent, opacifiers, hair swelling agents and/or polymers, humectants, moisturizers, viscosity enhancers, gelling agents, chelators, UV filters, antimicrobials preservatives, proteins or mixtures thereof.

The kits according to the present invention may further comprise additional components such as means to select the hair strands, means to load the application device (1) according to the present invention, means to mix and/or load said individually packaged hair treatment compositions (15), combs or brushes, gloves, caps with holes, tweezers, tongues, hooks or combination thereof.

In another embodiment the kit further comprises an individually packaged composition comprising an oxidizing agent and an individually packaged composition comprising an alkalizing agent. Preferably said oxidizing agent is hydrogen peroxide. More preferably, at least one of said individually packaged hair treatment composition comprises a persulfate salt.

The hair treatment application device (1) according to the present invention may be provided unassembled in the kits and instruction how to build the application device (1) of the present invention may be further provided in the kits described above. The kit—of parts comprising the application device (1) according to the present invention may further comprise instructions for consumers indicating how to load and/or use the application device (1), said instruction being recorded in any type of media such as the package of the kits itself, paper material, compact disk or the hair treatment application device (1) itself.

11. Test Methods

Median Pore Radius

There is no single method to measure median pore radii across the range of absorbent substrate selected for the purpose of the present invention. The median pore radius of the absorbent substrate was measured firstly via TRI Autoporosimeter™. For values obtained above 1000 microns the measurement was repeated via optical imaging and the value obtained with the optical imaging was taken as the final value.

The TRI Autoporosimeter™ is an automated, computer controlled instrument for measuring pore radii and their corresponding cumulative pore volumes (B. Miller and I. Tyomkin, Journal of Colloid and Interface Science, 162 (1994), 163-170). The median pore radius of a sample is the equivalent cylindrical radius where the cumulative volume of fluid absorbed/desorbed equals 50% of the saturation capacity of the test sample. The equivalent cylindrical radius can be afforded from the Laplace equation (I) that relates the hydrostatic pressure (pressure at 50% saturation) to pore radius:

$$R = \frac{2\gamma\cos\theta}{\Delta P} \quad \text{(I)}$$

where R is the effective radius, γ is the surface tension of the wetting liquid, θ is the contact advancing or receding contact angle of the liquid and ΔP is the pressure difference in hydrostatic head pressure across the sample. The median equivalent pore radius was typically determined from the desorption measurements, where θ is the receding contact angle. If the 50% value does not correspond to a pre-selected equivalent radius, then it can be determined graphically by interpolation.

The test sample, typically 50 mm in diameter, is placed in a measurement cell on a Millipore glass filter membrane (porosity of 1.2 microns) attached to a Monel support plate. The filter membrane and Monel metal support are prepared according to the manufacture's recommendations and attached via an epoxy based paint (Krylon High Gloss available from Swerin-Williams Corp.). Measurements are conducted with an applied pressure (confining weight) of 0.1 psi to ensure the test sample is in contact with the fluid test membrane.

The measurement cell is connected to a reservoir of the test liquid placed upon a balance. The TRI Autoporosimeter™ is used with n-hexadecane to wet the absorbent substrate. The weight (volume) of the liquid absorbed/desorbed by the absorbent substrate as a function of applied air pressure is recorded by the balance. As the air pressure increases and decreases, different size radius groups desorb and absorb liquid, respectively. The radius volume of each group is equal to this volume of liquid transferred. To ensure that all samples are tested under the same close to equilibrium conditions, the following parameters are recommended: (i) Equilibrium constant (liquid flow at each pressure step) is less than 90 mg/min, (ii) Balance weight data is collected every 15 seconds until desired equilibrium constant value is reached. The results are afforded as capillary pressure (cm), as a function of fluid weight on the balance (g).

Test samples with median pore radii greater than 1000 microns were determined by optical imaging. A test sample of about 50×50 mm was placed in an Olympus Stereo-Microscope connected to a digital camera. The dark field illumination technique was used to enhance the contrast and improve the visual appearance of the 3D structure. The applied magnifications are chosen to a) obtain regions of interest (ROIs) that represent the structure of the samples and b) enable reliable measurements of the pore sizes. The pore area of all the focused pores were manually measured in the ROIs and subsequently analyzed with the Olympus analySIS FIVE software to afford the accumulative surface pore area as a function of equivalent circular pore radius. The median pore radius of a sample is the equivalent circular radius where the cumulative pore area equals 50% of the total surface pore area. The measurements include pores that are not completely parallel to the focal plane, but observed from a viewing angle (due to the 3D structure).

The median pore radius was reported to the nearest micron (μm). The median pore radii and the other technical characteristic of some of the absorbent substrates according to the present invention are presented in table 5 below. Table 5 also shows absorbent substrates that do not satisfy the specifications claimed herein.

Absorbent Capacity

The absorption capacity was defined for a porous substrate as the mass of liquid absorbed per unit mass of dry solid substrate (see, for instance, Absorbent Technology, by Chatterjee and Gupta, Elsevier, 2002):

$$C = \frac{\rho_l}{\rho} \times \frac{\phi}{1-\phi}$$

where ρ is the density of the material making up the substrate, $\rho_1$, is the density of the liquid (for the stated Absorbent Capacities the density of pure water is used—1.00 g/cm$^3$) and ϕ is 1 minus the quotient of $\rho_{bulk}$ over ρ ($\rho_{bulk}$ is the bulk density of the porous substrate). For multi-component fibers/blends and non-cylindrical fibers, a weighted average solid fiber density was used. The results were reported in gram of fluid per gram of substrate (g/g).

Calliper

The calliper of the absorbent substrates was determined by the EDANA Recommended Test Method (ERT 30.5-99)—Thickness. An Abram Model 2000 micrometer with an accuracy of 0.01 mm and lowering speed of 3 mm/s and measuring pressure of 0.1 kPa was used (Technische Beratung Abram GmbH). The same method was applied to measure the calliper of foam substrates.

Basis Weight

The basis weight of the absorbent substrates was determined by the EDANA Recommended Test Method (ERT 40.3-90)—Mass per unit area. A substrate test area of 100×100 mm was accurately cut and weighed. The results reported as grams per square meter (g/m$^2$). The same method was applied to measure the basis weight of foam

TABLE 5

Technical characteristics of some absorbent substrates.

| Absorbent substrate | Median pore radius [microns] | Absorbent capacity [g/g] | Calliper [mm] | Basis weight [g/m$^2$] |
|---|---|---|---|---|
| Libeltex 01-766 DI-08 | 550 | 41 | 6.24 | 148 |
| PGI FB-215 | 700 | 57 | 7.83 | 136 |
| PGI FB-185 | 500 | 45 | 7.17 | 156 |
| Recticel Bulpren Foam S28280 | 1400 | 40 | 6.02 | 143 |
| Polyscorer Foam 410* | 2200 | 29 | 11.12 | 365 |
| PGI FB-213A | 700 | 41 | 4.94 | 118 |
| BBA Fiberweb Tenotex PL60L* | 70 | 7 | 0.46 | 59 |
| Freundenberg AL 1060 | 300 | 16 | 0.99 | 60 |

Mixing of Hair Treatment Compositions Method

When two or more hair treatment compositions are mixed prior to loading into the absorbent substrate as described herein the following procedure may be used. Said at least two hair treatment compositions, which may either be both liquid or one liquid and one powder, are placed into a vessel in a weight ratio between 1:10 and 10:1. This vessel may be of different forms, for example a bottle with a lid or an open compartment. In the case of the bottle, the two compositions are shaken for 2 minutes until the mixture is homogeneous. In the case of the open compartment the two compositions are mixed with a mixing implement for a period of time sufficient to produce a homogeneous mixed product. The mixed product produced via this method is the same as that obtained when the two compositions are loaded into separate absorbent materials and mixed as the absorbents are pressed together.

Viscosity Measurement Test Method

The viscosity of the hair treatment composition to be loaded into the absorbent substrate was measured using a Brookfield viscometer with cone and plate attachment. For viscosities in the range of about 0 cPs to 12,000 cPs the Brookfield DV-II+ viscometer with S42 plate was used. A sample of 2 ml of the hair treatment composition or Carbopol® 956 solution was equilibrated at 1 rpm at 26.7° C. for one minute prior to measurement, whereupon the readings are taken at 1 rpm. For viscosity values of about 12,000 cPs, another measurement is taken as described herein below.

For viscosities in the range of 12,000 cPs to about 100,000 cPs the Brookfield DV-II+ viscosities with S52 plate was used. A sample of 0.5 ml of the hair treatment composition or Carbopol® 956 solution was equilibrated at 1 rpm at 26.7° C. for one minutes prior to measurement, whereupon the readings are taken at 1 rpm. Again as explained above for viscosity values of 100,000 cPs, another measurement is taken as described herein below.

For viscosities in the range of 100,000-150,000 cPs the Brookfield DV-II+ viscometer with S52 plate is used. A sample of 0.5 ml of the hair treatment composition or Carbopol® 956 solution is equilibrated at about at 0.5 rpm 26.7° C. for one minutes prior to measurement, whereupon the readings are taken at 0.5 rpm.

Minimum Viscosity Limit Test

All absorbent substrates used in the following test methods had a calliper of from about 6 mm to about 10 mm. The required calliper was achieved for BBA Fiberweb Tenotex P101 and Freudenberg AL 1060 absorbent substrate by laminating multiply plies of the absorbent substrates by means of a hot melt adhesive positioned in circular droplets not greater than about 2 mm of diameter on each surface. The lamination was performed at the perimeter of the absorbent substrates.

The absorbent substrates were cut into circular pads of about 3.57 cm of diameter (surface area 10.0 cm$^2$), weighed and placed on the 4 cm diameter sinter glass disc of a about 80 cm$^3$ Pyrex Buchner funnel (available from Fisher; code FPJ-400-110D). The Carbopol® 956 solution was carefully added onto the absorbent substrate to a depth of about 1 cm after which a hand bellow, attached with a single hole rubber bung fitting into the opening of the funnel, were inflated and used to force the fluid into the absorbent substrate for about 1 minute. The absorbent substrate so loaded was removed carefully from the funnel with tweezers. Excess surface fluid was removed by placing two layers of laboratory tissue paper on a bench top and carefully passing the loaded absorbent substrate (handled with tweezers) over the tissue for a distance of about 30 cm, then turning the absorbent substrate and repeating for the other side. The loaded absorbent substrate was weighed and centrally fixed by means of 3M double sided tape onto the flat side of the circular test plate of about 4.97 cm diameter (made from rigid white acetal). The opposite plate was fitted with three brass pins appropriately selected such that the absorbent was compressed by about 3 mm when the surfaces of the two plates are parallel and vertically compressed. The brass pin height was set to about 3 mm for BBA Fiberweb Tenotex P101 and Libeltex 01-766 DI-8 whilst it was of about 7 mm for Recticel Bulpren S28280. The plate containing the brass pins was secured above a weighing boat with its surface perpendicular to the lab bench and the empty fourth pin hole in the lowest position vertical to the top brass pin. The plate containing the absorbent substrate was then vertically compressed against the pin plate for about 1 minute. The weight of the weighing tray and of any dripped hair treatment composition or Carbopol® 956 solutions was recorded and the percentage of the total fluid loaded that dripped out during the compression was calculated. The measurement was repeated three times for each experiment.

Determination of the Minimum Viscosity Limit: Consumer Panellist Study

Libeltex 01-766 DI-8 absorbent substrate was cut into two circular pads of about 3.57 cm diameter (surface area 10.0 $cm^2$) and loaded with Carbopol® 956 solutions having viscosities of about 1,000 cPs, about 2,500 cPs or about 5,000 cPs as described above. The loaded Libeltex 01-766 DI-8 absorbent substrate was centrally fixed to two hinged plates by means of 3M double sided tape. The panellists were given the application tool so prepared and asked to swipe twice a bundle of human hair of about 0.75 g in weight and of about 30.5 cm in length (Caucasion Light Brown—International Hair Imports and Products, Valhalla, N.Y.). Its performance was evaluated with the question "Considering the sample you have just used, how would you rate its mess?" Answers were rated on a 0 to 8 scale (0=not messy at all; 8=extremely messy).

Minimum Median Pore Radius Limit Test

The absorbent substrate samples (BBA Fiberweb Tenotex P101; Freudenberg AL 1060; Libeltex 01-766 DI-8; PGI FB-215 and Recticel Bulpren S28280), were cut into circular pads of 2.53 cm diameter (surface area of about 5.03 $cm^2$), weighed and placed on the sintered glass filter disc in a 30 $cm^3$ Duran Filter Assembly (Duran reference 24.720/24). A Viton ring was then placed upon the absorbent substrate such that the exposed absorbent had a diameter of about 1.8 cm (about 2.54 $cm^2$). The Duran Filter Assembly was attached and filled with the Carbopol® 956 solutions to a depth of about 1 cm by slow addition down the side of the glass head avoiding absorbent disturbance. Additional Carbopol® 956 solution was then poured into the glass head up to the graduated 30 $cm^3$ mark. After about 5 minutes the remaining fluid was separated and the absorbent substrates removed with tweezers. Any excess of surface fluid was removed by carefully passing the absorbent substrate over two layers of laboratory tissue paper a distance of about 30 cm for each side. The loading (grams of Carbopol® 956 solution per gram of absorbent substrate) was calculated based on the weight of the exposed absorbent substrate (surface area of about 2.54 $cm^2$) as follows and reported to two decimal places:

$$\text{Loading [g/g]} = \frac{2 \times (AS \text{ weight after loading}) - (AS \text{ weight before loading})}{(AS \text{ weight before loading})}$$

wherein AS means absorbent substrate.

Maximum Viscosity Limit Test

The Recticel Pottscorer 410 and Recticel Bulpren S28280 foams were cut into two circular pads of 3.57 cm diameter (surface area 10.0 $cm^2$) and loaded with a 100,000 cPs Carbopol® 956 solution as described in the determination of the minimum viscosity limit test method. The loaded pads were then centrally fixed, by means of 3M double sided tape, onto the flat sides of two test plates of 4.97 cm diameter. One of the plates was fitted with three 12 mm pins and secured on a clamp stand with the loaded Recticel Pottscorer 410 foam's surface perpendicular to the lab bench and the empty fourth pin hole at the lowest position. A 0.75 g bundle of hair (30.5 cm in length fanned to a width of 3 cm) was vertically compressed between the Recticel Pottscorer 410 and Recticel Bulpren S28280 foams on the pin plate and the second parallel plate. The hair was swiped twice in between the compressed foam such that the whole length of the hair bundle took three seconds to pass through. This was repeated on a different second and a third hair bundle. Each experiment as described above was repeated three times. The weights of the hair bundles were recorded and the results calculated as grams of Carbopol® 956 solution deposited per gram of hair.

12. Examples

Several exemplary hair treatment compositions are described below for incorporation within one or more exemplary absorbent substrates. The absorbent substrates of the following examples can be optionally adhered to an application tool. Preferably, the absorbent substrates are mounted onto two injection moulded polypropylene plates of about 12.5 $cm^2$ surface area, hinged together, with the absorbent substrates facing one another.

Example A

Hair Highlighting Using Peroxide and Alkalizer Compositions Via an Absorbent Substrate Two circular disks of about 12.5 $cm^2$ are cut from an about 150 grams-per-square meter polyester high loft batting nonwoven substrate (01-766 DI-8 available from Libeltex, Belgium; FB-215 available from PGI, New Jersey). Also polyurethane sponge (Bulpren S28280 available from Recticel International, Belgium) may be employed within this example.

| Peroxide composition (1) | % w/w | Alkalizer composition (2) | % w/w |
|---|---|---|---|
| De-ionized Water | q.s. to 100% | De-ionized Water | q.s. to 100% |
| Glycerine | 5.00 | Ammonium Hydroxide (30% Active) | 0.00 |
| Hydrogen Peroxide (35% Active) | 17.20 | Ammonium bicarbonate (100% active) | 20.0 |
| Disodium EDTA | 0.04 | Carbopol ® 956 | 1.80 |
| Carbopol ® 956 | 2.25 | pH | 8.80 |
| Sodium Hydroxide (50% aq. Solution) | q.s. to pH 2.9 | | |
| Viscosity | 15,400 cPs | Viscosity | 8,100 cPs |

Viscosity of compositions (1) and (2) when mixed = 24,000 cPs

The Carbopol® 956 used to prepare the peroxide composition (1) is hydrated in rapidly mixing water until homogenous either by slow manual addition or by using an eductor or similar device for rapid hydration of powders. This example specifically reports Carbopol® 956 as the thickening agent for the peroxide and alkalizer compositions (1) and (2), but other thickening agents are contemplated. The hydrogen peroxide is then added with moderate mixing so as not to introduce excess air bubbles into the system. Then, 50% sodium hydroxide is added dropwise as appropriate to adjust the pH to the indicated value. Optionally, additional peroxide stabilizers such as sodium stannate may be added to further reduce the likelihood of premature peroxide decomposition. Once the peroxide composition (1) is prepared the viscosity according to the test method described herein above is measured.

The alkalizer composition (2) is produced by hydrating the Carbopol® 956 in rapidly mixing water either by slow manual addition or by using an eductor or similar device for rapid hydration of powders. When the Carbopol® 956 is fully dispersed and homogenous, the ammonium hydroxide or ammonium bicarbonate is added with moderate mixing so as to avoid entrapping excess air bubbles. The batch will thicken and clear with the addition of the alkalizer. Once the alkalizer composition (2) is prepared the viscosity according to the test method described herein above is measured.

About 4 grams of peroxide composition (1) are loaded into one of the two absorbent substrate disks and approximately 4 grams of the alkalizer composition (2) are loaded into the other absorbent substrate disk. The compositions are loaded by even application across the absorbent substrate surface with a pipette or syringe with gentle mechanical pressing with the pipette or syringe to ensure that the majority of the composition is fully absorbed into the substrate and without sacrificing the integrity of the absorbent substrate.

The plates are pressed together from two to ten times so to compress and squeeze the absorbent substrates and to sufficiently mix the peroxide composition (1) and the alkalizer composition (2).

Once the hair treatment application system is ready it is used to treat the hair according to the hair treatment test described below. The hair so treated compared to a control hair tress was visually lighter.

Hair Treatment Test

A tress of human hair (Caucasion Light Brown—International Hair Imports and Products, Valhalla, N.Y.) of about 30.5 cm in length and about 0.8 gram in weight is prepared by binding one end of the hair strands with a plastic cable tie about 2 cm from the hair ends and further securing with a 3 cm strip of electrician's tape. This hair tress is hung on a stainless-steel slotted holder. The top of the hair tress is then contacted with the hair treatment application system so that the tress is between the two absorbent substrates attached to the plates. The hair treatment application system is then pulled through to the end of the hair tress while maintaining the plates juxtaposed. The application may be repeated a second time. The resulting hair tress, which has between about 0.3 to about 0.8 grams of the hair treatment compositions deposited onto it, is then placed on a weigh boat and stored in an oven at about 30° C. for about 30 minutes. The hair tress is then rinsed with water and left to dry.

Example B

Hair Coloured Highlights Using Peroxide and Oxidative Dyes Compositions Via an Absorbent Substrate Absorbent substrates are prepared as described in Example A above.

| Peroxide Composition (3) | % w/w | Oxidative Dyes + Alkalizer Composition (4) | % w/w |
|---|---|---|---|
| De-ionized Water | q.s. to 100% | De-ionized Water | q.s. to 100% |

-continued

| Peroxide Composition (3) | % w/w | Oxidative Dyes + Alkalizer Composition (4) | % w/w |
|---|---|---|---|
| Glycerine | 5.00 | Ethanolamine | 4.00 |
| Hydrogen Peroxide (35% Active) | 17.20 | Propylene glycol | 5.00 |
| Disodium EDTA | 0.04 | Carbopol ® 956 | 1.00 |
| Carbopol ® 956 | 1.00 | Glycerine | 5.00 |
| Sodium Hydroxide (50% aq. Solution) | q.s. to pH 3.5 | Sodium Sulphite | 0.30 |
| Viscosity | 10,500 cPs | EDTA | 0.10 |
| | | Erythorbic acid | 0.40 |
| | | 1-Naphthol | 0.10 |
| | | Para-aminophenol | 0.85 |
| | | 1-hydroxy-4,5-diaminopyrazole sulfate | 0.30 |
| | | Phenyl Methyl Pyrazolone | 0.20 |
| | | 2-methyl-5-hydroxyethyl aminophenol | 1.50 |
| | | pH | 10.0 |
| | | Viscosity | 6,800 cPs |

Viscosity of compositions (3) and (4) when mixed = 17,100 cPs

The peroxide composition (3) is produced by combining the Carbopol® 956 with the glycerine and mixing until a homogenous slurry is obtained. De-ionized water is charged into a separate container of sufficient size to contain the entire batch. The slurry is introduced into the water slowly and mixed with moderate agitation until a stable, homogenous composition is observed. The hydrogen peroxide is then added with moderate mixing so as not to introduce excess air bubbles into the system. Then, sodium hydroxide is added dropwise to increase the pH to about 3.5. Optionally, additional peroxide stabilizers such as sodium stannate may be added to further reduce the likelihood of premature peroxide decomposition.

Oxidative dye and alkalizer composition (4) is produced by hydrating the Carbopol® 956 in rapidly mixing water either by slow manual addition or by using an eductor or similar device for rapid hydration of powders. When the Carbopol® 956 is fully dispersed and homogenous, all the remaining ingredients are added, apart from the ethanolamine (i.e. glycerine, dye precursors, pH buffers and antioxidants). Once they have dissolved, the ethanolamine is added with moderate mixing so as to avoid entrapping excess air bubbles. The batch will thicken and clear with the addition of the alkalizer. A hair tress is treated as described above in the hair treatment test. A light copper shade was visually determined on the treated tress when compared to a control hair tress.

Example C

Hair Highlights Using Persulfates and Peroxide Composition Via an Absorbent Substrate Absorbent substrates are prepared as described in Example A above.

Approximately 6 grams of peroxide composition (3) are mixed with about 4 grams of persulfate powder 5 in a weigh boat with a spatula. Approximately 4 grams of the resulting mixture are loaded into each of the absorbent substrates and a hair tress is treated as described above in the hair treatment test.

| Persulfate powder (5) | % w/w |
|---|---|
| Ammonium Persulfate | 28.6 |
| Potassium Persulfate | 50.0 |
| Sodium Persulfate | 7.1 |
| Sodium Metasilicate | 14.3 |

Viscosity of compositions (3) and (5) when mixed = 6,000 cPs

Peroxide composition (3) is prepared as described above in example B. Persulfate powders are produced by the dry blending all the ingredients, in any order, in a suitable blending apparatus such as a V-blender. The composition should be combined to homogeneity. The persulfate powder so formed is then pre-mixed with the peroxide composition (3). The mixing may be performed in a bottle, bowl or tray where the ingredients are intermixed together via shaking or stirring. The resulting composition is loaded into the absorbent substrate and then applied to the hair.

This hair highlighting composition may provide a high level of decolorizing effect in a short amount of time. The resulting hair tress has experienced significant bleaching compared to a control hair tress as determined on a Minolta Spectograph.

Example D

Root-Touch-Up Using Direct Dye Composition or Peroxide Composition with Oxidative Dyes Via an Absorbent Substrate A square piece (about 25 $cm^2$) is cut from a roll of about 150 grams-per-square meter polyester high loft batt non-woven substrate (01-766 DI-8 available from Libeltex, Belgium). The absorbent piece is adhered to the center of an about 6×6 cm piece of 1 mm thick clear polyethylene film with 3M two-sided tape. About 7.5 grams of direct dye composition (6) is loaded into the absorbent substrate (3,000 grams of direct dye composition (6) per square meter of absorbent substrate) on a weigh scale using a pipette or a syringe. The direct dye composition (6) is applied evenly across the absorbent substrate surface with gentle mechanical pressing with the pipette or syringe to ensure that the majority of the direct dye composition (6) is fully absorbed into the substrate. The resulting loaded absorbent substrate adhered to the polyethylene film is then rubbed into the root-line of a mannequin head (available from Salons Direct (Pro-hair) with gloved fingers touching the polyethylene side and the absorbent substrate side being rubbed into and across the hair root-line. The resulting mannequin head is left to sit for 30 minutes and then rinsed and shampooed. The root-line of the mannequin head has experienced a light brown coloration.

| Direct Dyes Composition (6) | % w/w |
|---|---|
| De-ionized Water | q.s. to 100% |
| HC Yellow No. 2 | 0.20 |
| Disperse Black 9 | 0.05 |
| HC Red No. 3 | 0.15 |
| Disperse Violet 1 | 0.05 |
| Erythorbic Acid | 0.03 |
| Citric Acid | 0.5 |
| Ethanolamine | 2.5 |
| Carbopol ® 956 | 0.83 |
| HC Orange No. 1 | 0.1 |

-continued

| Direct Dyes Composition (6) | % w/w |
|---|---|
| pH | 10.1 |
| Viscosity | 12,100 cPs |

Root-touch-up can be achieved with oxidative dyes by employing the exact procedure above, but with pre-mixing about 4 grams of peroxide composition (3) and about 4 grams of oxidative dye and alkalizer composition (4) as described above in example B. An amount of about 7.5 grams of resulting mixture is loaded into the absorbent substrate as described above. The resulting composition is applied on a mannequin head as described above at the root-line. After removing the composition a light brown coloration has been observed.

Non-limiting additional examples of other hair treatment compositions and cosmetic compositions having viscosity as selected herein are exemplified here below.

EXAMPLE E

| Shampoo composition | % w/w |
|---|---|
| De-ionized Water | q.s. to 100% |
| Sodium laureth sulfate | 12.0 |
| Cocamidopropyl betaine | 3.0 |
| Viscosity | 3,750 cPs |

EXAMPLE F

| Conditioner shampoos | % w/w |
|---|---|
| De-ionized Water | q.s. to 100% |
| Ammonium Laureth Sulfate | 10.00 |
| Ammonium Lauryl Sulfate | 6.00 |
| Cocamide MEA | 0.80 |
| Cetyl Alcohol | 0.90 |
| Ethylene Glycol Distearate | 1.50 |
| Dimethicone (Viscasil 330,000) | 1.35 |
| Polyquaternium-10 (LR30M) | 0.50 |
| Polyox PEG7M | 0.10 |
| Puresyn 6 (1-decene homopolymer) | 0.30 |
| Perfume | 0.50 |
| Citric Acid | 0.04 |
| Sodium Citrate Dihydrate | 0.40 |
| Disodium EDTA | 0.10 |
| Kathon (0.5% active) | 0.01 |
| Sodium Benzoate | 0.25 |
| Sodium Chloride | q.s. to 8,000 cps |
| Ammonium Xylene Sulfonate | q.s. to 8,000 cps |
| Viscosity | 8,000 cPs |

EXAMPLE G

| Conditioners | % w/w |
|---|---|
| De-ionized Water | q.s. to 100% |
| Cetyl Alcohol *1 | 1.0 |
| Stearyl Alcohol *2 | 0.6 |
| Stearamidopropyl Dimethylamine *3 | 1.0 |
| Zinc pyrithione *4 | 2.0 |
| Benzyl alcohol | 0.4 |
| Phenoxy Ethanol | 0.3 |
| Methyl Paraben | 0.2 |
| Propyl Paraben | 0.1 |
| Hydroxyethyl Cellulose | 0.3 |
| PEG-2M | 0.5 |
| Emulsifying Wax | 0.5 |
| Perfume | 0.4 |

EXAMPLE G-continued

| Conditioners | % w/w |
|---|---|
| Citric acid | q.s. to pH 6 |
| Viscosity | 11,500 cPs |

*1 Cetyl Alcohol: Konol series available from Shin Nihon Rika.
*2 Stearyl Alcohol: Konol series available from Shin Nihon Rika.
*3 Stearamidopropyl Dimethylamine: SAPDMA available from Inolex.
*4 Zinc pyrithinone: Zinc pyrithione U/2 available from Olin

EXAMPLE H

| Hair Styling Compositions | % w/w |
|---|---|
| De-ionized Water | q.s. to 100% |
| Acrylates/beheneth-25 Methylacrylate Copol | 2.5 |
| NATRASOL 250 | 0.6 |
| Benzyl alcohol | 0.5 |
| Acrylates Copolymer | 0.4 |
| Polyquaternium 4 | 1.4 |
| Laureth 23 (Polyoxyethylene (23) Lauryl+ | 1.6 |
| Viscosity | 57,500 cPs |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed a "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hair treatment application system comprising a) at least one or more hair treatment compositions having a viscosity of from about 3,000 cPs to about 150,000 cPs and b) a hair treatment application device comprising a first plate and a second plate wherein said first and second plates each has an internal and external surface and said first and second plates each has a perimeter edge and wherein said first and second plates are coupled together via a connection that allows the hair treatment application device to be in a closed state or in an open state and wherein when the hair treatment application device is in a closed state, said first plate is in juxtaposed relationship to said second plate whereas when the hair treatment application device is in an open state said first plate is distant from said second plate characterized in that at least said first plate has on the internal surface at least a first zone and at least a second zone, wherein said at least first zone comprises at least one absorbent substrate, wherein said at least one absorbent substrate has a median pore radius of from about 300 microns to about 3,000 micron; wherein said at least second zone is free of said absorbent substrate; wherein the connection comprises a spring back pressure to open ranging from 0.01N/cm$^2$ to 30.0 N/cm$^2$; and wherein when the hair treatment application device is in an open state, the angle between said internal surfaces of said first and second plates is between 30° and 185°.

2. The system according to claim 1, wherein said at least second zone of said internal surface of said at least first plate is adjacent to said first zone.

3. The system according to claim 1, wherein said at least second zone of said internal surface of said at least first plate is adjacent to said first zone and comprises a material selected from the group consisting of a porous compressible material, a porous non-compressible material, a non-porous compressible material, a non-porous non-compressible material, at least one tine, at least one bristle and a combination thereof.

4. The system according to claim 1, wherein at least a portion of said first plate comprises a depression.

5. The system according to claim 1, wherein at least a portion of said first plate comprises a cavity.

6. The system according to any one of the preceding claims, wherein said at least one absorbent substrate extends as a continuous strip along said perimeter edge of said at least first plate and upward from said internal surface and wherein said continuous strip defines an area on said internal surface of said first plate where said hair treatment composition may be loaded.

7. The system according to claim 1, wherein said at least one absorbent substrate comprises an inner surface which is in direct contact with said internal surface of said first plate, an outer surface and a lateral side, wherein at least a portion of said lateral side of said at least one absorbent substrate comprises an impervious membrane.

8. The system according to claim 1, wherein said at least first plate comprises at said perimeter edge a strip of continuous or discontinuous non-porous material to wipe off excessive deposition of hair treatment composition when said first plate is brought into juxtaposed relationship to said second plate.

9. The system according to claim 1, wherein said connection is a hinge.

10. A kit comprising at least one hair treatment application system according to claim 1 and further comprising one or more individually packaged hair treatment compositions selected from the group consisting of shampoo compositions, conditioning compositions, styling compositions, hair colourant compositions, hair bleaching compositions, highlighting compositions and combinations thereof.

11. A kit comprising at least one hair treatment application system according to claim 1 and further comprising instruction for consumers indicating how to load and/or use said hair treatment application device.

* * * * *